US007063228B2

(12) United States Patent
Mita et al.

(10) Patent No.: US 7,063,228 B2
(45) Date of Patent: Jun. 20, 2006

(54) PACKAGING BAG

(75) Inventors: Kozo Mita, Tokyo-to (JP); Atsuko Takahagi, Tokyo-to (JP); Hiroko Nozaki, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 157 days.

(21) Appl. No.: 10/295,205

(22) Filed: Nov. 15, 2002

(65) Prior Publication Data

US 2003/0123758 A1 Jul. 3, 2003

(30) Foreign Application Priority Data

Nov. 16, 2001 (JP) ..... P2001-351225
Dec. 19, 2001 (JP) ..... P2001-385560
Dec. 19, 2001 (JP) ..... P2001-385585

(51) Int. Cl.
*B65D 25/16* (2006.01)

(52) U.S. Cl. ..... 220/495.03; 383/66

(58) Field of Classification Search ..... 383/66; 220/495.03

See application file for complete search history.

(56) References Cited

U.S. PATENT DOCUMENTS 4,367,842 A * 1/1983 Rausing ..... 383/66
4,810,844 A * 3/1989 Anderson ..... 219/727

FOREIGN PATENT DOCUMENTS

| | | |
|---|---|---|
| JP | 02-084908 | 3/1990 |
| JP | 09-142541 | 6/1997 |
| JP | 09-240754 | 9/1997 |
| JP | 10-072070 | 3/1998 |
| JP | 10-095471 | 4/1998 |
| JP | 3048391 | 5/1998 |
| JP | 11-113740 | 4/1999 |
| JP | 2000-072187 | 3/2000 |
| JP | 2000-118575 | 4/2000 |
| JP | 2000-159277 | 6/2000 |
| JP | 2000-168851 | 6/2000 |

* cited by examiner

*Primary Examiner*—Stephen Castellano
(74) *Attorney, Agent, or Firm*—Ladas & Parry LLP

(57) ABSTRACT

Packaging bag which comprises a main body walls of which envelops a first internal space, a wing part which envelops a second internal space, a point-seal part formed within the wing part, and a steam permeable means located within an area which is isolated from the first and second inner spaces by the point-seal part; wherein the first internal space is used for storing contents and is subjected to sealing to make a sealed space after contents storing, wherein the wing part is formed of two walls mutually-faced and extended from the wall of the main body in the direction of intersecting to the face of main body, and wherein the second inner space is communicated with the first internal space at an end thereof and closed at other ends thereof.

61 Claims, 29 Drawing Sheets

PACKAGING BAG

BACKGROUND OF THE INVENTION

1. Field of the Invention

This invention relates to a packaging bag for seal-packaging of food, etc. Particularly, this invention relates to a packaging bag which can be heated in its sealed state for retaining food, etc., therein, with an electromagnetic wave heating system such as a microwave oven.

2. Related Art

In order to eat the food which is seal-packaged into the packaging bag or the like, there may be cases where heating or heat-cooking by the microwave oven is appreciated or needed. In such cases, the internal pressure of the packaging system will be built up with the steam generated by the heating as long as the packaging is kept as tight seal condition. As the result, the packaging bag explodes, and contents in the bag are scattered over inside of microwave oven. Such problem is well known in the art and various methods for solving the problem have been proposed.

For example, in Japanese Utility Model Registration No. 3048391, a packaging bag which has a notch at side seal portion thereof has been proposed. In JP-H10-72070A, a packaging bag which has a notch capable of breaking the seal condition of the bag has been also proposed. In this literature, the notch is formed at a wing-like part which is branched from a main body of the packaging bag and has an inner space communicated with the inner space of main body. In JP-2000-72187A, a packaging bag which has a prearranging portion for steam release port being arranged from a breakable notch and in a line with another prearranging portion for contents pouring port has been proposed. In JP-2000-118575A, it is disclosed that a thin film tape of easy peel-off type is used for a part of opening of self-standing pouch and that the seal by the tape part concerned is released by the internal pressure of pouch. In JP-2000-168851A, a weak seal part is formed in a part of seal portion at a bottom of bag, and the weak seal part concerned is released by the internal pressure of the bag. In JP-10-95471A, the packaging bag which has a weak seal area formed in a part of edge seal part, and further has a narrow seal part formed in a part of the weak seal area is proposed. In the packaging bag of JP-9-142541A, while making a central seal part into a weak seal part by carrying out heat fusion at low temperature rather than other parts, two or more linear gap parts is formed in the bottom seal part. In the packaging bag of JP-9-240754A, a part of the bag is made of nonwoven fabric in order to release the steam therefrom. In the container for microwave oven heating of JP-H2-84908A, a V-shape seal portion which protrudes interiorly is prepared as an area of edge seal part of the container, so as to concentrate the internal pressure of the container at the portion.

However, in the case of Japanese Utility Model Registration No. 3048391, when the food to be stored therein is that possesses fluidity, such as liquid, etc., such a bag cannot be adopted since the contents can easily leak out. Moreover, in JP-H10-72070A or JP-2000-72187A, the work of making a cut or hole in advance of heating is troublesome. Furthermore, to forget the work before heating is liable to occur. In that case, the bag will explode, and it is so dangerous. Since the types of easy peel-off and weak seal disclosed as JP-2000-118575A, JP-2000-168851A, and JP-10-95471A express insufficient seal strength, such bags have a possibility of seal-breakage during transportation. In JP-9-240754A, the sealing performance as a packaging bag can not be expected.

SUMMARY OF THE INVENTION

Therefore, this invention aims to provide a new packaging bag. Further, this invention aims to provide a packaging bag for electromagnetic wave heating such as a microwave oven heating, which can prevent the burst of the bag by steam generated by heating even when the closed seal system is not released before heating.

This invention which solves the above mentioned purposes is a packaging bag which comprises a main body walls of which envelops a first internal space, a wing part which envelops a second internal space, a point-seal part formed within the wing part, and a steam permeable means located within an area which is isolated from the first and second internal spaces by the point-seal part; wherein the first internal space is used for storing contents and is subjected to sealing to make a sealed space after contents storing, wherein the wing part is formed of two walls mutually-faced and extended from the wall of the main body in the direction of intersecting to the face of main body, wherein the second internal space is communicated with the first internal space at an end thereof and closed at other ends thereof.

In the packaging bag of this invention, control seal parts can be prepared within the wing part almost in parallel with the tail end edge of a wing part and toward the point-seal part from the both side edge seal parts of the bag.

Moreover, in the packaging bag of this invention, the point-seal part can be continuously formed from the seal part or fold part at the tail end edge of a wing part.

Furthermore, in the packaging bag of this invention, an area isolated from the first and second internal spaces can be formed by the control seal part formed in the wing part, and an additional steam permeable means can be prepared also in this area. It can consider as a secondary safe release means in case the point-seal part and the steam permeable means formed therein do not fully function. Further, separately from the point-seal part and the steam permeable means, a portion to be fractured can prepare in the packaging bag of this invention. It can make the point-seal part and the steam permeable means a secondary safe release means in case the fracturable part concerned does not fully function. Moreover, the packaging bag of this invention may have a casing box for storing the bag, which box has an prearranging portion capable of forming an opening, at the position that the wing part of the packaging bag installed therein is located, wherein the opening is that for pulling out the wing part to the outside of a box.

The first preferable embodiment of the packaging bag according this invention is the packaging bag for heating with electromagnetic wave heating system, which comprises a lower member and an upper member, each of which is made of a composite film which has a sealant layer at least one side, wherein the lower member uses the sealant side as the upper face, a portion of the upper member forms a wing part by doubling the portion while facing the sealant layer thereof mutually and sealing the open end edges of the double, the remaining portion of the upper member is superposed on the lower member so that the sealant side of the remaining portion is used as the lower face to be opposite to the upper face of lower member, and the edges of superposed members are sealed, and wherein the wing part comprises a point-seal part formed therein, and a steam permeable means located within an area which is isolated from the first and second internal spaces by the point-seal part.

In the first embodiment of the packaging bag of this invention, it is preferable that the point-seal part is located at the position that the radius of the circle which touches the lowest end of a point-seal part from a center in the bag is shorter than the radius of the circle which touches the inner end of the side edge seal part of the bag, when circles are drawn by centering on the center of the bag.

In the first embodiment of this invention, the packaging bag wherein the non-seal part is formed inside the point-seal part is shown.

In the first embodiment of this invention, the packaging bag wherein the pattern seal part is formed inside the point-seal part is shown.

In the first embodiment of this invention, the packaging bag the steam permeable means of which is a cut or a hollow is shown.

In the first embodiment of this invention, it is desirable that the distance between the lowest end of one or more cuts or hollows prepared in the point-seal part and the lowest end of point-seal part is 2–10 mm.

In the first embodiment of this invention, it is desirable that the ratio of the length between an end edge in the longitudinal direction of the packaging bag and the formation position of the wing part, to the length between the formation position of the wing part and the opposite end edge in the longitudinal direction of the packaging bag is in the range of 1/50 to 2/3.

In the first embodiment of this invention, the packaging bag wherein the upper member consists of two pieces of film is shown.

In the first embodiment of this invention, the packaging bag wherein the upper member consists of one piece of film is shown.

In the first embodiment of this invention, the packaging bag wherein the upper member and the lower member are composed of a single piece of film is shown.

The second preferable embodiment of the packaging bag of this invention is the packaging bag for heating with electromagnetic wave heating system, which comprises a lower member and an upper member, each of which is made of a composite film which has a sealant layer at least one side, wherein the lower member uses the sealant side as the upper face, a portion of the upper member forms a wing part by doubling the portion while facing the sealant layer thereof mutually and sealing the open end edges of the double, the remaining portion of the upper member is superposed on the lower member so that the sealant side of the remaining portion is used as the lower face to be opposite to the upper face of lower member, and the edges of superposed members are sealed, and wherein the wing part comprises a point-seal part formed therein, a steam permeable means located within an area which is isolated from the first and second internal spaces by the point-seal part, and control seal parts which is almost in parallel with the tail end edge of a wing part and toward the point-seal part from the both side edge seal parts of the bag.

In the second embodiment of the packaging bag of this invention, it is preferable that the point-seal part is located at the position that the radius of the circle which touches the lowest end of a point-seal part from a center in the bag is shorter than the radius of the circle which touches the inner end of the side edge seal part of the bag, when circles are drawn by centering on the center of the bag.

In the second embodiment of this invention, it is preferable that the end of the control seal part on the center side of the bag is located at a position between the circle which touches the lowest end of the steam permeable means and the circle which touches the uppermost end of the point-seal part, when coaxial circles are drawn by centering on the center of the bag, and the ratio of the length between the side edge of the packaging bag and the side edge of the point-seal part, to the length between the side edge of the packaging bag and the center side end of the control seal part is in the range of 8/7 to 8/3.

In the second embodiment of this invention, the packaging bag wherein the non-seal part is formed inside the point-seal part is shown.

In the second embodiment of this invention, the packaging bag wherein the pattern seal part is formed inside the point-seal part is shown.

In the second embodiment of this invention, the packaging bag the steam permeable means of which is a cut or a hollow is shown.

In the second embodiment of this invention, it is desirable that the distance between the lowest end of one or more cuts or hollows prepared in the point-seal part and the lowest end of point-seal part is 2–10 mm.

In the second embodiment of this invention, it is desirable that the ratio of the length between an end edge in the longitudinal direction of the packaging bag and the formation position of the wing part, to the length between the formation position of the wing part and the opposite end edge in the longitudinal direction of the packaging bag is in the range of 1/50 to 2/3.

In the second embodiment of this invention, the packaging bag wherein the control seal parts are formed in axial symmetry with respect to the axis in the longitudinal direction of the bag is shown.

In the second embodiment of this invention, the packaging bag, wherein another part isolated from the first and second internal space is prepared by the control seal part, and a steam permeable means is prepared also in this isolated part, are indicated.

In the second embodiment of this invention, the packaging bag which has a seal strength of the seal part provided in the wing part is not more than 25N/15 mm width at the temperature of not less than 90° C. is shown.

In the second embodiment of this invention, the packaging bag wherein the upper member consists of two pieces of film is shown.

In the second embodiment of this invention, the packaging bag wherein the upper member consists of one piece of film is shown.

In the second embodiment of this invention, the packaging bag wherein the upper member and the lower member are composed of a single piece of film is shown.

The third preferable embodiment of the packaging bag of this invention is the packaging bag for heating with electromagnetic wave heating system, which comprises a lower member and an upper member, each of which is made of a composite film which has a sealant layer at least one side, wherein the lower member uses the sealant side as the upper face, a portion of the upper member forms a wing part by doubling the portion while facing the sealant layer thereof mutually and sealing the open end edges of the double, the remaining portion of the upper member is superposed on the lower member so that the sealant side of the remaining portion is used as the lower face to be opposite to the upper face of lower member, and the edges of superposed members are sealed, and wherein the wing part comprises a point-seal part formed therein and which is continuously formed from the seal part or fold part at the tail end edge of a wing part, a steam permeable means located within an area which is isolated from the first and second internal spaces by the point-seal part.

In the third embodiment of this invention, the packaging bag which further comprises control seal parts prepared within the wing part almost in parallel with the tail end edge of the wing part and toward the point-seal part from the both side edge seal parts of the bag is disclosed.

In the third embodiment of the packaging bag of this invention, it is preferable that the point-seal part is located at the position that the radius of the circle which touches the lowest end of a point-seal part from a center in the bag is shorter than the radius of the circle which touches the inner end of the side edge seal part of the bag, when circles are drawn by centering on the center of the bag.

In the third embodiment of this invention, the packaging bag wherein the non-seal part is formed inside the point-seal part is shown.

In the third embodiment of this invention, the packaging bag wherein the pattern seal part is formed inside the point-seal part is shown.

In the third embodiment of this invention, the packaging bag the steam permeable means of which is a cut or a hollow is shown.

In the third embodiment of this invention, it is desirable that the distance between the lowest end of one or more cuts or hollows prepared in the point-seal part and the lowest end of point-seal part is 2–10 mm.

In the third embodiment of this invention, it is desirable that the ratio of the length between an end edge in the longitudinal direction of the packaging bag and the formation position of the wing part, to the length between the formation position of the wing part and the opposite end edge in the longitudinal direction of the packaging bag is in the range of 1/50 to 2/3.

In the third embodiment of this invention, it is preferable that the end of the control seal part on the center side of the bag is located at the position between the circle which touches the lowest end of the steam permeable means and the circle which touches the uppermost end of the point-seal part, when coaxial circles are drawn by centering on the center of the bag, and the ratio of the length between the side edge of the packaging bag and the side edge of the point-seal part, to the length between the side edge of the packaging bag and the center side end of the control seal part is in the range of 8/7 to 8/3.

In the third embodiment of this invention, the packaging bag wherein the control seal parts are formed in axial symmetry with respect to the axis in the longitudinal direction of the bag is shown.

In the third embodiment of this invention, the packaging bag, wherein another part isolated from the first and second internal space is prepared by the control seal part, and a steam permeable means is prepared also in this isolated part, are indicated.

In the third embodiment of this invention, the packaging bag which has a seal strength of the seal part provided in the wing part is not more than 25N/15 mm width at the temperature of not less than 90° C. is shown.

In the third embodiment of this invention, the packaging bag wherein the upper member consists of two pieces of film is shown.

In the third embodiment of this invention, the packaging bag wherein the upper member consists of one piece of film is shown.

In the third embodiment of this invention, the packaging bag wherein the upper member and the lower member are composed of a single piece of film is shown.

The fourth preferable embodiment of the packaging bag of this invention is the packaging bag for heating with electromagnetic wave heating system, which comprises a lower member and an upper member, each of which is made of a composite film which has a sealant layer at least one side, wherein the lower member uses the sealant side as the upper face, a portion of the upper member forms a wing part by doubling the portion while facing the sealant layer thereof mutually and sealing the open end edges of the double, the remaining portion of the upper member is superposed on the lower member so that the sealant side of the remaining portion is used as the lower face to be opposite to the upper face of lower member, and the edges of superposed members are sealed, wherein a fracturable portion is formed at a site of the sealed edge parts of the bag, and wherein the wing part comprises a point-seal part formed therein, and a steam permeable means located within an area which is isolated from the first and second internal spaces by the point-seal part.

In the fourth embodiment of this invention, the fracturable portion is a notch formed at a site of the tail end edge of the wing part is disclosed.

Alternatively, the fourth preferable embodiment of the packaging bag of this invention is the packaging bag for heating with electromagnetic wave heating system, which comprises a lower member and an upper member, each of which is made of a composite film which has a sealant layer at least one side, wherein the lower member uses the sealant side as the upper face, a portion of the upper member forms a wing part by doubling the portion while facing the sealant layer thereof mutually and sealing the open end edges of the double, the remaining portion of the upper member is superposed on the lower member so that the sealant side of the remaining portion is used as the lower face to be opposite to the upper face of lower member, and the edges of superposed members are sealed, wherein a fracturable portion is formed at a site of the sealed edge parts of the bag, and wherein the wing part comprises a secondary seal portion formed therein, the secondary seal portion being distinct from the edge seal part, and a steam permeable means located within an area which is isolated from the first and second internal spaces by the secondary seal portion.

In this fourth embodiment of this invention, the fracturable portion is a notch formed at a site of the tail end edge of the wing part is disclosed.

In the fourth embodiment of the packaging bag of this invention, it is preferable that the secondary seal portion is a point-seal part which is located at the position that the radius of the circle which touches the lowest end of a point-seal part from a center in the bag is shorter than the radius of the circle which touches the inner end of the side edge seal part of the bag, when circles are drawn by centering on the center of the bag.

In the fourth embodiment of this invention, the packaging bag wherein the non-seal part is formed inside the point-seal part is shown.

In the fourth embodiment of this invention, the packaging bag wherein the pattern seal part is formed inside the point-seal part is shown.

In the fourth embodiment of this invention, the packaging bag the steam permeable means of which is a cut or a hollow is shown.

In the fourth embodiment of this invention, it is desirable that the distance between the lowest end of one or more cuts or hollows prepared in the point-seal part and the lowest end of point-seal part is 2–10 mm.

In the fourth embodiment of this invention, it is desirable that the ratio of the length between an end edge in the longitudinal direction of the packaging bag and the formation position of the wing part, to the length between the formation position of the wing part and the opposite end edge in the longitudinal direction of the packaging bag is in the range of 1/50 to 2/3.

In the fourth embodiment of this invention, the packaging bag wherein the upper member consists of two pieces of film is shown.

In the fourth embodiment of this invention, the packaging bag wherein the upper member consists of one piece of film is shown.

In the fourth embodiment of this invention, the packaging bag wherein the upper member and the lower member consist of a single piece of film is shown.

The fifth embodiment of this invention is a packaging container comprising the packaging bag according to one of the above mentioned first to fourth embodiments and a casing box for storing the bag, wherein the box has an prearranging portion capable of forming an opening, at the position that the wing part of the packaging bag installed therein is located, wherein the opening is that for pulling out the wing part to the outside of the box.

BRIEF DESCRIPTION OF THE DRAWINGS

FIGS. 1A–E are drawings which show the packaging bag for microwave oven heating according to one embodiment of the packaging bag of this invention, wherein FIG. 1A is a perspective view, FIG. 1B is a perspective view which explains the constituent member of a packaging bag, FIG. 1C is X1—X1 line sectional view of FIG. 1B, FIG. 1D and FIG. 1E are sectional views showing the example of layer constitution of the laminate which constitutes a packaging bag;

FIGS. 2A–E are side views of principal part which explain the point-seal part of the packaging bag for microwave oven heating according to one embodiment of the packaging bag of this invention, wherein FIG. 2A shows the point-seal part in which the point-seal part is solidly sealed, FIG. 2B shows the point-seal part which forms non-seal part therein, FIG. 2C shows the point-seal part which forms pattern seal part therein, and FIG. 2D shows an example where a cut is provided in the point-seal part, and FIG. 2E shows an example where a hollow is provided in the point-seal part, respectively;

FIGS. 3A–B are drawings which explain the arrangement position of the steam permeable means in the packaging bag for microwave oven heating according to one embodiment of the packaging bag of this invention, wherein FIG. 3A is the plane view and FIG. 3B is the X2—X2 line sectional view of FIG. 3A;

FIGS. 6A–B are drawings which explain the shape of the packaging bag in an Example mentioned later of the packaging bag of this invention, wherein FIG. 6A is the whole configuration view and FIG. 6B is a principal part configuration view showing a wing part;

FIGS. 7A–B are views which explain the shape of the packaging bag in a referential example mentioned later, wherein FIG. 7A is a whole configuration view and FIG. 7B is a principal part configuration view showing a wing part;

FIGS. 8A–B are views which explain the shape of the packaging bag in another referential example mentioned later, wherein FIG. 8A is a whole configuration view and FIG. 8B is a principal part configuration view showing a wing part;

FIGS. 9A–G are drawings which explain the packaging bag for microwave oven heating according to the second embodiment of the packaging bag of this invention, wherein FIG. 9A is a perspective view, FIG. 9B is a principal part sectional view which explains a point-seal part and a steam permeable means, FIG. 9C is a principal part sectional view which explains a point-seal part and a steam permeable means in another constructive example, FIG. 9D is a principal part sectional view which explains a point-seal part and a steam permeable means in further another constructive example, FIG. 9E is a principal part sectional view which explains a point-seal part in the wing seal part in still another constructive example, FIG. 9F is a drawing which explains locations of a point-seal part, control seal part, and etc., in the packaging bag, and FIG. 9G is X3—X3 line sectional view of FIG. 9F FIGS. 10A–C are drawings which explain a constructive example according to the second embodiment of the packaging bag of this invention, wherein

FIGS. 11A–C are drawings which explain another constructive example according to the second embodiment of the packaging bag of this invention, wherein FIG. 11A is a perspective view of the packaging bag, FIG. 11B is a perspective view of a modified example, and FIG. 11C is a perspective view which explains two constitutive members of the packaging bag;

FIGS. 12A–C are drawings which explain another constructive example according to the second embodiment of the packaging bag of this invention, wherein FIG. 12A is a perspective view of the packaging bag, FIG. 12B is a perspective view of a modified example, FIG. 12C is a perspective view of another modified example.

FIGS. 13A–D are sectional views of principal part which explain the point-seal part of the packaging bag for microwave oven heating according to second embodiment of the packaging bag of this invention, wherein FIG. 13A shows an example of the point-seal part in which the point-seal part is solidly sealed, FIG. 13B shows another example of the point-seal part in which the point-seal part is solidly sealed, FIG. 13C shows further another the point-seal part which forms non-seal part therein, FIG. 13D shows still another point-seal part which forms pattern seal part therein, respectively;

FIG. 16 are drawings which explain the shape of the packaging bag in an Example mentioned later according to the second embodiment of the packaging bag of this invention, wherein

FIG. 17 are views which explain the shape of the packaging bag in a referential example mentioned later, wherein

FIG. 18 are views which explain the shape of the packaging bag in another referential example mentioned later, wherein

FIGS. 19A–H are drawings which explain the packaging bag for microwave oven heating according to the third embodiment of the packaging bag of this invention, wherein FIG. 19A is a perspective view of whole configuration, FIG. 19B is a principal part sectional view which explains a point-seal part and a steam permeable means in the wing part, FIG. 19C is a principal part sectional view which explains a point-seal part and a steam permeable means in another constructive example, FIG. 19D is a principal part sectional view which explains a point-seal part and a steam permeable means in further another constructive example, FIG. 19E is a principal part sectional view which explains a point-seal part in the wing seal part in still another constructive example, FIG. 19F is a drawing which explains locations of a point-seal part, control seal part, and etc., in the packaging bag, FIG. 19G is X5—X5 line sectional view of FIG. 19F, and FIG. 19H is a drawing which explains the length of a control seal part;

FIGS. 20A–C are drawings which explain the structure of an example according to the third embodiment of the packaging bag of this invention, wherein FIG. 20A is a perspective view of the packaging bag, FIG. 20B is a perspective view which explains three constitutive members of the packaging bag, and FIG. 20C is X6—X6 line sectional view of FIG. 20B;

FIGS. 21 A–E are drawings which explain the structure of other examples according to the third embodiment of the packaging bag of this invention, wherein

FIGS. 22A–D are sectional views of principal part which explain the point-seal part of the packaging bag for microwave oven heating according to third embodiment of the packaging bag of this invention, wherein FIG. 22A and FIG. 22B show examples of the point-seal part in which the point-seal part are solidly sealed, FIG. 22C shows another example of the point-seal part which forms non-seal part therein, FIG. 22D shows still another point-seal part which forms pattern seal part therein, respectively;

FIGS. 25A–D are drawings which explain the structure of an example according to the fourth embodiment of the packaging bag of this invention, wherein FIG. 25A is a perspective view of the whole part of the packaging bag before heating, FIG. 25B is a perspective view of the whole part of the packaging bag, which shows schematically the steam diffusion in the state the steam is generated by heating, FIG. 25C is a schematic X7—X7 line sectional view of FIG. 25B, FIG. 25D is a sectional view of the principal part of packaging bag, which shows schematically the steam diffusion in the case of heating after the previous opening of the steam release means;

FIGS. 26A–C are drawings which explain the structure of an example according to the fourth embodiment of the packaging bag of this invention, wherein FIG. 26A is a perspective view of the packaging bag, FIG. 26B is a perspective view which explains three constitutive members of the packaging bag, and FIG. 26C is X8—X8 line sectional view of FIG. 26B;

FIGS. 29A–B are drawings which explain the structure of an example of the packaging container of this invention, wherein FIG. 29A is a perspective view which shows the appearance of the packaging container at the time of heating with the microwave oven, and FIG. 29B is X9—X9 line sectional view of FIG. 29A;

FIGS. 30A–B are drawings which explain the packaging container shown in FIGS. 29A–B, wherein FIG. 30A is a perspective view which shows the appearance of the packaging container in the distribution process, and FIG. 30B is X10—X10 line sectional view of FIG. 30A;

FIGS. 33A–C are drawings which show another example of the casing box used in the packaging container according to this invention, wherein FIG. 33A is a perspective view in the distribution process, FIG. 33B is a perspective view in the state that the opening for pulling out the wing part is prepared, and FIG. 33C is a perspective view in the state that the wing part of a packaging bag is stood on.

PREFERRED EMBODIMENTS OF THE INVENTION

Figure 1A:
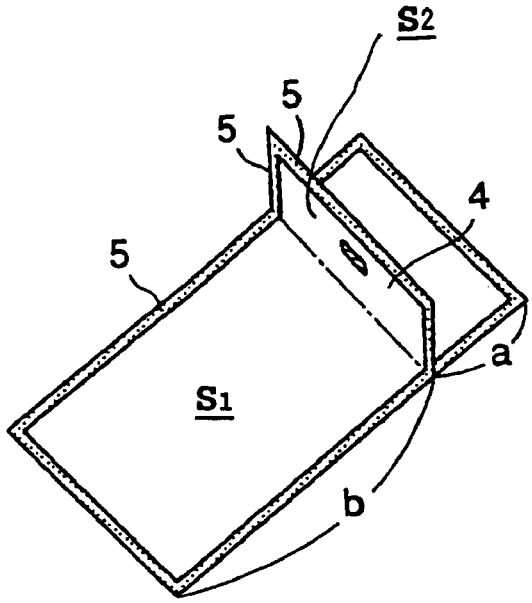

This invention will be hereafter disclosed in detail based on preferred embodiments.

The packaging bag according to this invention is a packaging bag which comprises a main body walls of which envelop a first internal space, a wing part which envelops a second internal space, a point-seal part formed within the wing part, and a steam permeable means located within an area which is isolated from the first and second internal spaces by the point-seal part, wherein the first internal space is used for storing contents and is subjected to sealing to make a sealed space after contents storing, wherein the wing part is formed of two walls faced-faced and extended from the wall of the main body in the direction of intersecting to the face of main body, wherein the second internal space is communicated with the first internal space at an end thereof and closed at other ends thereof.

The word "point-seal" used herein means a seal part of a comparatively small area and which is provided in a bag as distinct from peripheral edge seal part (main seal part) with which the bag is sealed to form a sealed bag. It is not limited especially as the shape of the point-seal part. The point-seal part may be the form separated from the main seal part, or may be connected with the edge seal part of the wing part. Although not limited especially as the size of this point-seal part, the seal area of a point-seal part may be about 0.5–10 $cm^2$, for example.

Accordingly, the packaging bag of this invention can be heated in its horizontal configuration. Moreover, even when the packaging bag of this invention is heated with the microwave oven on condition that the user has forgotten to establish a steam release port in the packaging bag, or on condition that the established steam release port would be blocked with a certain cause, or on condition that the packaging bag has maintained its seal system without especially establishing such port, the steam generated by heating can diffuse out from the bag without bursting the bag. Because, the steam generated by heating migrates from the first internal space to the second internal space which is associated with the first internal space and is formed in the wing part, then, by virtue of the steam's force, seal regression at the point-seal part will arise, which is followed by communicating the internal spaces with the steam permeable means in the wing part.

In a desirable embodiment of the packaging bag according to this invention, a control seal part can be prepared within the wing part almost in parallel with the tail end edge of a wing part and toward the point-seal part from the both side edge seal parts of the bag.

By providing the control seal part, the rapid exfoliation at the point seal part and rapid burst of bag can be prevented, and smooth steam release operation can be attained.

In another desirable embodiment of the packaging bag according to this invention, the above-mentioned point-seal part can be continuously formed from the seal part or fold part at the tail end edge of a wing part.

By shaping the point-seal part in this manner, it can prevent that the pressure cannot be easily applied to a point-seal part. Also it can prevent that the contents of bag gets into the space between the point seal part and the tail end edge of the wing part, thus, it can avoid degrading the appearance of the packaging bag as a commercial products.

Furthermore, in another desirable embodiment of the packaging bag according to this invention, an area isolated from the first and second internal spaces can be formed by the control seal part formed in the wing part, and an additional steam permeable means can be prepared also in this area. It can consider as a secondary safe release means in case the point-seal part and the steam permeable means formed therein do not fully function. Alternatively, separately from the point-seal part and the steam permeable means, a portion to be fractured can prepare in the packaging bag of this invention. It can make the point-seal part and the steam permeable means a secondary safe release means in case the fracturable part concerned does not fully function.

Moreover, in another desirable embodiment according to the packaging bag of this invention, the packaging bag may have a casing box for storing the bag, which box has an prearranging portion capable of forming an opening, at the position that the wing part of the packaging bag installed therein is located, wherein the opening is that for pulling out the wing part to the outside of a box. When having such a casing box, handling of the packaging bag in a heated state can be improved, as compared with the packaging bag alone. The casing box will not become so hot, and thus, there is no worry about a burn. Moreover, since the wing part can be successfully held upwardly from the main body of the bag which is set in its horizontal configuration, the steam release operation on heating can be attained more smoothly.

Although there is especially no restriction in the members which constitute the bag, the number of members, etc. as far as the bag has the structure described above with respect to the packaging bag according to this invention, the preferable are those manufactured by using a composite film of which a sealant layer is provided at least one side, as shown concretely below.

Moreover, although a microwave oven is typical and the microwave oven is explained as an example in the following explanation as the electromagnetic wave heating equipment used for heating the contents thing stored in the packaging bag of this invention, the equipment is not limited to such an oven type at all, and various kinds of cooking utensils using the electromagnetic wave on heating, such as an electric cooking range and the like, are involved as the electromagnetic wave heating equipment.

FIG. 1 shows the packaging bag according to one desirable embodiment of the packaging bag of this invention. The packaging bag 1 for microwave oven heating according to the first embodiment has a wing part 4 on one side of the main body of a bag, as shown in FIG. 1A. This wing part 4 forms a second internal space S2 which is communicated with a first internal space S1 of the main body of the bag at an end thereof and closed at other ends thereof.

Figure 2A:
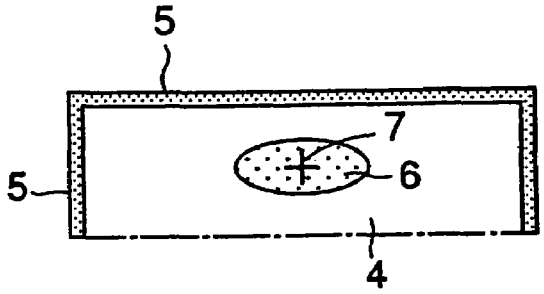
Figure 2B:
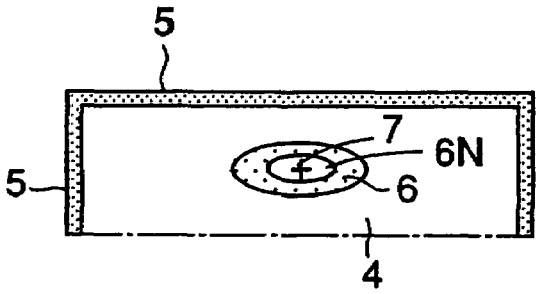
Figure 2C:
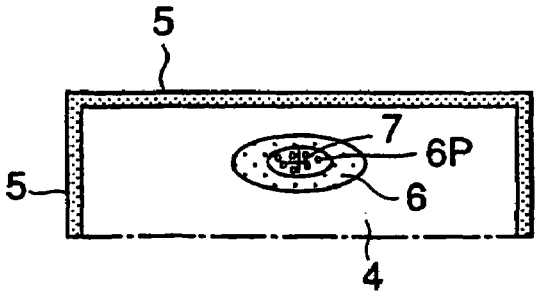

This packaging bag can be heated with a microwave oven in a state of setting as the upper side the face in which the above-mentioned wing part 4 is formed. In the wing part 4, as shown in FIG. 2A–FIG. 2C, the point-seal part 6 and the steam release means 7 or 8 are formed. Even if a steam release port is not established beforehand on the occasion of heating, the steam generated by microwave oven heating can be diffused out from the bag through the steam release means 7 or 8, since exfoliation and regression of sealed area of the above-mentioned point-seal part 6 would be caused by virtue of the heat and pressure of the generated steam.

Figure 1B:
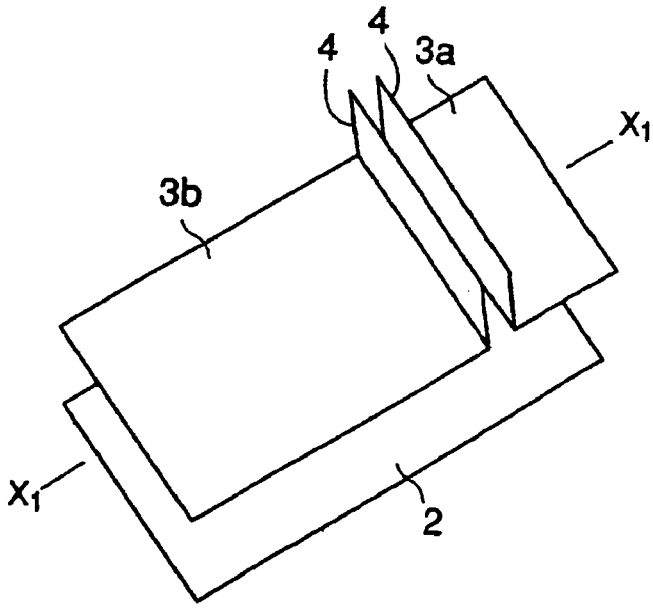
Figure 1C:
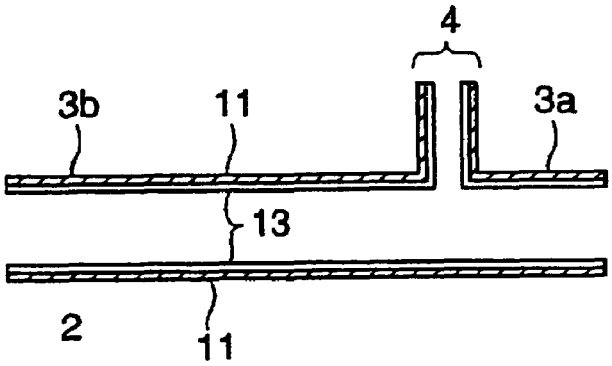
Figure 2D:
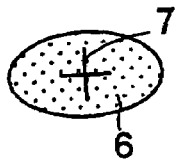
Figure 2E:
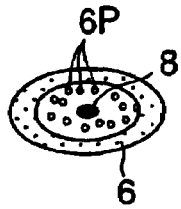

In the packaging bag 1 for microwave oven heating according to the first embodiment, the wing part 4 is formed in the portion located in the upper part when a bag is laid on a plane, as shown in FIG. 1A–FIG. 1C, and the point-seal part 6 is formed in the domain of this wing part 4, and further the steam release means such as the cut 7 as shown in FIG. 2A–FIG. 2D or the hollow 8 as shown in FIG. 2E is formed within the inside region of the point-seal part 6 which is isolated from the internal spaces of the packaging bag by the point-seal. When heating, the heat and pressure generated by heating induces the exfoliation and regression of the point-seal part 6, which is followed by the natural opening of the isolated inside region so as to release the steam through the steam release means 7 or 8. Thus, the breakage of the bag on heating can be prevented. Since the packaging bag 1 of this invention can be subjected to microwave oven heating in its horizontal configuration where the wing part 4 is set as the upper side, it can be used for a fluidal food. Namely, as described above, on the heating with the microwave oven, automatic opening is produced by the exfoliation and regression of the point-seal part and the following communication of the internal spaces of the bag with the cut or hollow. Thus, without troublesome step for providing an opening cut or the like in advance of heating, the steam generated in the bag can get away from the bag through the communicated cut or hollow. Therefore, the heating operation will become safety. Further, no need for providing an opening cut or the like will give a convenience.

The packaging bag 1 for microwave oven heating according to the first embodiment is a bag using the composite film of which a sealant layer is provided at least one side. As shown in FIG. 1A, FIG. 1B, and FIG. 1C, the bag 1 is manufactured by superposing, onto a lower member 2 which uses the sealant layer 13 as the upper face, upper members 3*a*, 3*b*, wherein portions of the upper members 3*a*, 3*b* forms a wing part 4 by doubling the portions while facing the sealant layers 13*a*, 13*b* thereof mutually, and the remaining portions of the upper members are layered on the lower member 2 so that the sealant layer 13 of the remaining portions is used as the lower face of the upper members to be opposite to the upper face of lower member, and sealing the open edges of superposed members including the open end edges of the wing part so as to form the main seal part 5 for sealing up the bag.

Although it is a matter of course, in the state where contents are not stored in the bag, one side or a part of the bag is maintained in its non-seal state, and the seal of this open part is completed after the contents filling.

As shown in FIGS. 1B–C, in this example, the upper members consist of two pieces. However, when the wing part is formed by a similar bending processing, it is possible to form the whole upper member as one piece, or further possible to form the upper member and lower member jointly as one piece.

Then, as shown in FIG. 2A–FIG. 2C, the point-seal part 6 is formed in the above-mentioned wing part. The shape of the point-seal part may be a square, a rectangle, a circle, an ellipse, a triangle, etc., but is not limited thereto.

The point-seal part 6 may be formed as solid seal as shown in FIG. 2A, or may be formed with surrounding an unsealed part 6N as shown in FIG. 2B, or may be formed with surrounding dotted pattern seal part 6P as shown in FIG. 2C. Regardless of such shapes, since the point seal part exists in an inner position of the bag (wing part) and is independent of the main seal part, the point seal part tends to suffer the stress rather than the main seal part when expanding the internal spaces of the bag.

As the steam permeable means formed in the inside of point seal part, any means capable of diffusing the steam out of the bag when it is communicated with the internal spaces of the container would be applicable, wherein the communication is attained by the exfoliation and regression of the point-seal part which is induced with the heat of the steam and the enhanced inner pressure generated by heating of the contents in the container. For example, the steam permeable means may be formed as a cut as shown in FIG. 2D, or as a hollow as shown in FIG. 2E.

Figure 4:
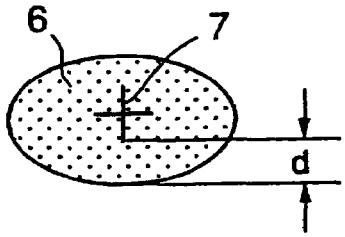
FIG. 4 is a principal part enlarged drawing which explains the position of the steam permeable means in a point-seal part.

Moreover, although the distance d between the lower end of the steam permeable means (FIG. 4 is the example of a cut) prepared in the point-seal part 6 and the lower end of the point-seal part 6, as shown in FIG. 4, is not particularly limited, it is desirable in the range of 2–10 mm and more particularly, in the range of 5–8 mm. When the above-mentioned distance d is smaller than 2 mm, the strength to vibration, falling, etc. will become weak, and a possibility that a bag is damaged during the distribution of products will be raised. Conversely, when larger than 10 mm, a possibility that a steam penetration cannot happen easily and breakage of the bag from other seal parts will take place can be considered.

Figure 3A:
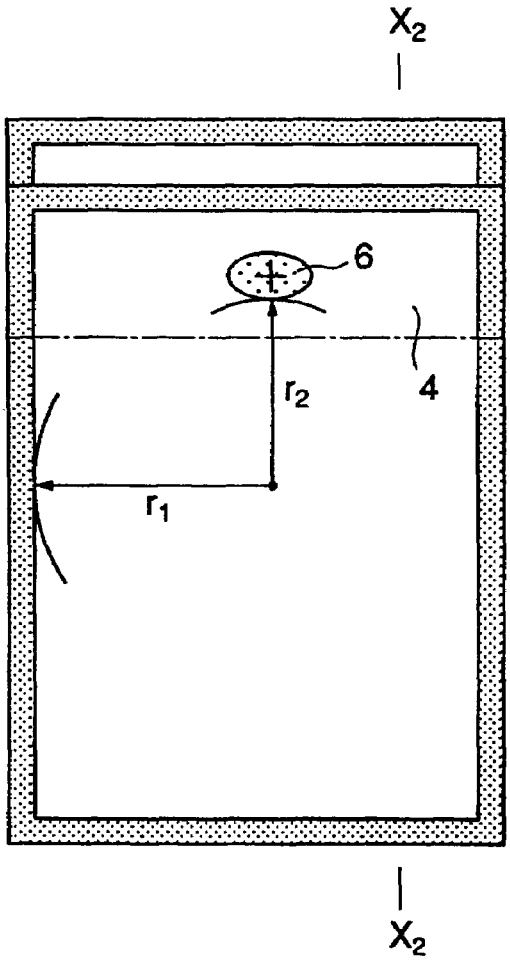
Figure 3B:
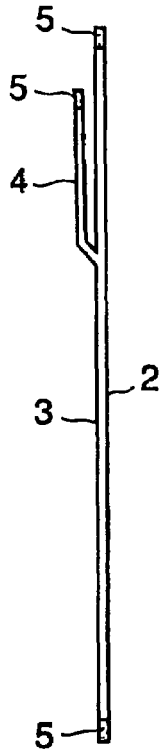

Regarding the position of the point seal part 6, it is preferable that the point-seal part 6 is located at the position that the radius r2 of the circle which touches the lowest end of a point-seal part 6 from the center M in the packaging bag is shorter than the radius r1 of the circle which touches the inner end of the side edge seal part of the bag, when circles are drawn by centering on the center M of the packaging bag as shown in FIG. 3A. When the radius r2 is longer than the radius r1, there is a possibility that exfoliation and regression in the seal part by virtue of the enhanced heat and internal pressure generated by heating may take place in the main seal part at the side of the packaging bag, and the breakage of a packaging bag and leakage of contents may arise.

In the first embodiment of this invention, with respect to the location of the wing part provided in the packaging bag for microwave oven heating, it is desirable to satisfy the condition that the ratio "a/b" of the length "a" between an end edge in the longitudinal direction of the packaging bag and the formation position of the wing part, to the length "b" between the formation position of the wing part and the opposite end edge in the longitudinal direction of the packaging bag as shown in FIG. 1A is in the range of 1/50 to 2/3. When it is within the above range, the force for promoting the exfoliation and regression by heat and enhanced internal pressure will be well applied to the point-seal part 6 provided in the wing part, and thus, automatic opening will be better attained.

Figure 5A:
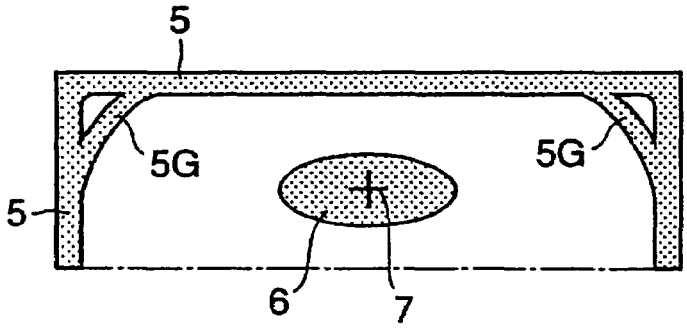
FIG. 5A and FIG. 5B are a principal part sectional views showing the constitutive example of the guide seal part in the wing part of the packaging bag for microwave oven heating according to one embodiment of the packaging bag of this invention.
Figure 5B:
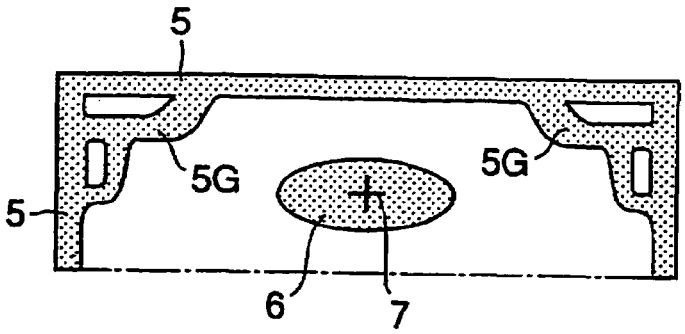

Moreover, as shown in FIG. 5A or FIG. 5B in addition to the above-mentioned point-seal part 4, it is possible to prepare a guide seal part 5G in the wing part in order to aid the point-seal part to be opened.

Next, the layered product 10 which may be used for preparing the packaging bag 1 for microwave oven heating according to the first embodiment is explained. Although the above-mentioned packaging bag 1 may be formed with a single plastic film having heat-seal ability, it is desirable that the bag is formed with a layered product which comprises at least a substrate layer 11 and a sealant layer 13 as shown in FIG. 1D and FIG. 1E, from the standpoints of, such as the bag strength, heat resistance, and contents protection, etc.

Figure 1D:
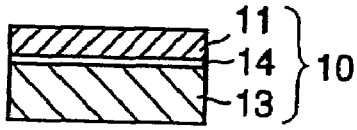
Figure 1E:
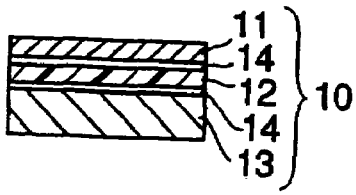

The above-mentioned layered product may consist of a substrate layer 11 and a sealant layer 13, as shown in FIG. 1D. Alternatively, as shown in FIG. 1E, it may have a inter layer 12 arranged between the substrate layer 11 and the sealant layer 13. Furthermore, according to the functions to be given to the bag, it may be that of more multiple layered structure. Moreover, the laminating of the above-mentioned layered product 10 may be manufactured through the adhesion layers 14 which consist of adhesive resin or the like and which are provided between each stacking layers constituting the layered product.

The substrate layer 11 of the layered product 10 which is used for the packaging bag 1 for microwave oven heating according to the first embodiment will not be particularly limited, as far as it may be used in general as a package material for food which is subjected to heating or heat-cooking with a microwave oven. Further, the substrate layer 11 may be a single layer or a multilayer (layered product), and it can be chosen from the materials generally used for the package material for food by which heating or heating cooking is generally carried out with a microwave oven.

For example, an oriented polyethylene terephthalate film, a silica deposited oriented polyethylene terephthalate film, an alumina deposited oriented polyethylene terephthalate film, an oriented nylon film, a silica deposited oriented nylon film, an alumina deposited oriented nylon film, an oriented polypropylene film, a poly vinyl alcohol coated oriented polypropylene film, a nylon 6/methaxylenediamine nylon 6 coextruded cooriented film, a polypropylene/ethylene-vinyl alcohol copolymer coextruded cooriented film, or the like may be cited. Further, the substrate layer may be a complex film which is prepared by laminating two or more above mentioned film.

The melt point of the substrate layer 11 may be 150° C. or more usually, and the thickness thereof may be 10–50 μm, preferably, 10–30 μm.

As the resin which constitutes the sealant layer 13, what is used in general as a package material for food which is subjected to heating or heat-cooking with a microwave oven can be also used.

For example, a low density polyethylene, an ultra low density polyethylene, a straight chained low density polyethylene, a medium density polyethylene, a high density polyethylene, a non-oriented polyethylene, an ethylene-vinyl acetate copolymer, an ethylene-acrylic acid copolymer, an ethylene-metacrylic acid copolymer, an ethylene-methyl acrylate copolymer, ethylene-ethyl acrylate copolymer, ethylene-methyl methacrylate copolymer, ionomer or the like may be cited. The sealant layer may be formed by the extrusion laminating of such a resin. Alternatively, the sealant layer may be prepared by making a film from such a resin with T-die method or inflation method in advance, and stacking to a heat-resistant substrate layer the obtained film with using the dry lamination or the extrusion laminating method. In the layered product which constitutes the packaging bag 1 for microwave oven heating according to the first embodiment, thickness of the sealant layer is in the range of 20–100 μm, preferably, in the range of 40–70 μm.

The laminating of substrate layer 11 and the sealant layer 13 will not be limited especially, and any conventionally known methods such as the coextrusion laminating method, the dry laminating method, etc. are adaptable to the laminating.

Moreover, in order to give mechanical strength as a packing material, such as barrier property and stabbing resistance, etc., the layered product 10 may be provided with a middle layer 12.

As the middle layer 12, what is used in general as a package material for food which is subjected to heating or heat-cooking with a microwave oven can be also used, and concrete examples thereof are similar to those exemplified as the above-mentioned substrate layer 11.

As described above, since the packaging bag 1 for microwave oven heating according to the first embodiment is provided with a wing part at the upper side thereof, even if it has liquid contents, it can be heated in its horizontal configuration by which the wing part 4 is located at upper side. Further, due to the formation of the steam releasing port at the upper position of the wing part, it can be heated stably and amply without the explosion of the bag or leakage of the internal fluidal foods.

Furthermore, even if a steam releasing port is not prepared in advance of heating, the bag can be heated without the explosion of the bag, by virtue of the point-seal part and steam permeable means mentioned above.

FIGS. 9A–G show the packaging bag according to the second desirable embodiment of the packaging bag of this invention.

Figure 9A:
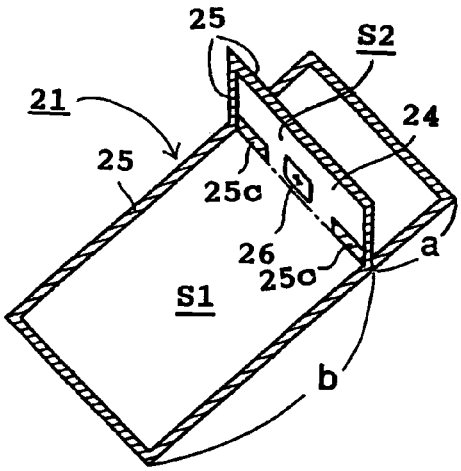

The packaging bag 21 for microwave oven heating according to this second embodiment is a bag which formed the wing part 24 in one side of the main body of a bag, as shown in FIG. 9A. This wing part 24 forms a second internal space S2 which is communicated with a first internal space S1 of the main body of the bag at an end thereof and sealed at other ends thereof.

This packaging bag can be heated with a microwave oven in a state of setting as the upper side the face in which the above-mentioned wing part 24 is formed. In the wing part 24, as shown in FIG. 9A–FIG. 9E, the point-seal part 26 and the steam release means 27 or 28 are formed. Even if a steam release port is not established in advance of heating, the steam generated by microwave oven heating can be diffused out from the bag through the steam release means 27 or 28, since exfoliation and regression of sealed area of the above-mentioned point-seal part 26 would be caused by virtue of the heat and pressure of the generated steam.

Figure 10A:
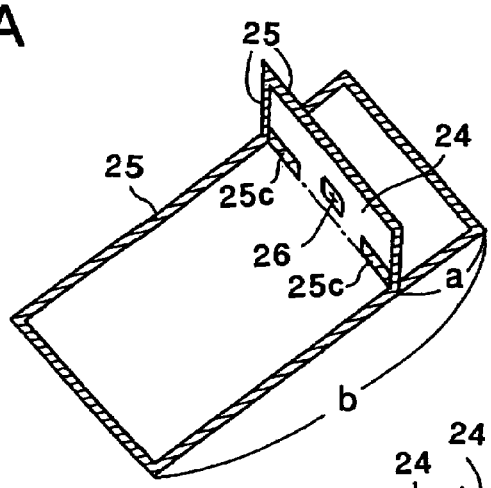
FIG. 10A is a perspective view of the packaging bag.
Figure 10B:
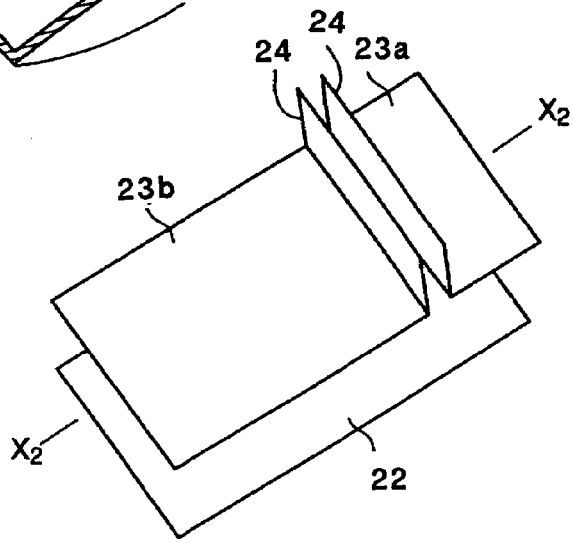
FIG. 10B is a perspective view which explains three constitutive members of the packaging bag.
Figure 14A:
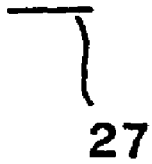
FIGS. 14A–D are drawings which show examples of the shape of the steam permeable means in the point-seal part of the packaging bag according to this invention.
Figure 14B:
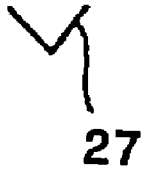
Figure 14C:
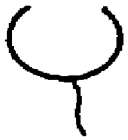
Figure 14D:
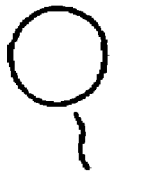

In the packaging bag 21 for microwave oven heating according to the second embodiment, the wing part 24 is formed in the portion located in the upper part when a bag is laid on a plane, as shown in FIG. 10A–FIG. 10B, and the point-seal part 26 is formed in the domain of this wing part 24, and further the steam release means such as the cut 27 as shown in FIG. 14A–FIG. 14C or the hollow 28 as shown in FIG. 14D is formed within the inside region of the point-seal part 26 which is isolated from the internal spaces of the packaging bag by the point-seal. When heating, the heat and pressure generated by heating induces the exfoliation and regression of the point-seal part 26, which is followed by the natural opening of the isolated inside region so as to release the steam through the steam release means 27 or 28. Thus, the breakage of the bag on heating can be prevented. Since the packaging bag 21 of this embodiment can be subjected to microwave oven heating in its horizontal configuration where the wing part 24 is set as the upper side, it can be used for a fluidal food. Namely, on the heating with the microwave oven, automatic opening is produced by the exfoliation and regression of the desired part 26 and the following communication of the internal spaces of the bag with the cut 27 or hollow 28. Thus, without troublesome step for providing an opening cut or the like in advance of heating, the steam generated in the bag can get away from the bag through the communicated cut or hollow. Therefore, the heating operation will become safety. Further, no need for providing an opening cut or the like will give a convenience.

Since the cut 27 or hollow 28 resides in an inner position of the point seal part, the complete sealing performance of the bag during the distribution of products can be ensured.

Figure 10C:
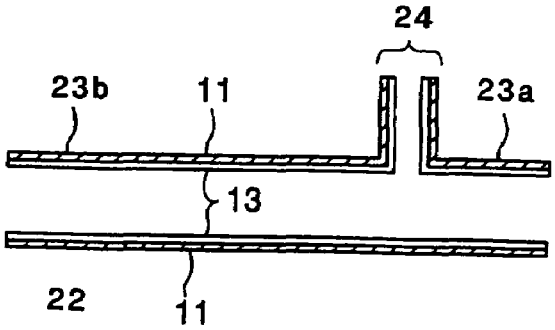
FIG. 10C is X4—X4 line sectional view of FIG. 10B.

The packaging bag 21 for microwave oven heating according to the second embodiment is a bag using the composite film of which a sealant layer is provided at least one side. As shown in FIG. 10A, FIG. 10B, and FIG. 10C, the bag 21 is manufactured by superposing, onto a lower member 22 which uses the sealant layer 13 as the upper face, upper members 23*a*, 23*b*, wherein portions of the upper members 23*a*, 23*b* forms a wing part 24 by doubling the portions while facing the sealant layers 13*a*, 13*b* thereof mutually, and the remaining portions of the upper members are layered on the lower member 22 so that the sealant layer 13 of the remaining portions is used as the lower face of the upper members to be opposite to the upper face of lower member, and sealing the open edges of superposed members including the open end edges of the wing part so as to form the main seal part 25 for sealing up the bag.

Although it is a matter of course, in the state where contents are not stored in the bag, one side or a part of the bag is maintained in its non-seal state, and the seal of this open part is completed after the contents filling.

Figure 11A:
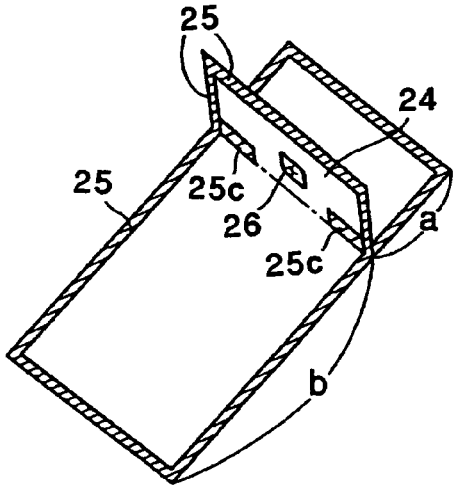
Figure 11B:
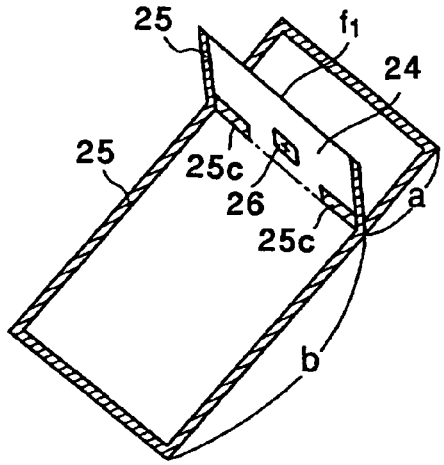
Figure 11C:
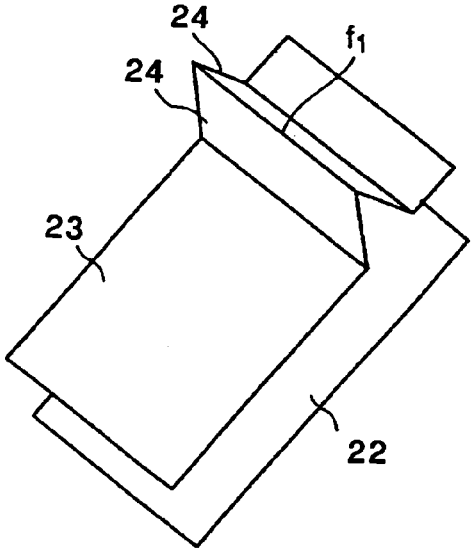

As shown in FIGS. 10B–10C, in this example, the upper members consist of two pieces. As a fashion of manufacturing the packaging bag with the wing part, however, to form the whole upper member as one piece and shape the wing part by the bending processing as shown in FIGS. 11A–11C can be also adopted. In this fashion, the tail end edge of the wing part may have a seal as shown in FIG. 11A or not have a seal so as to remain as a fold f1 as shown FIG. 11B.

Figure 12A:
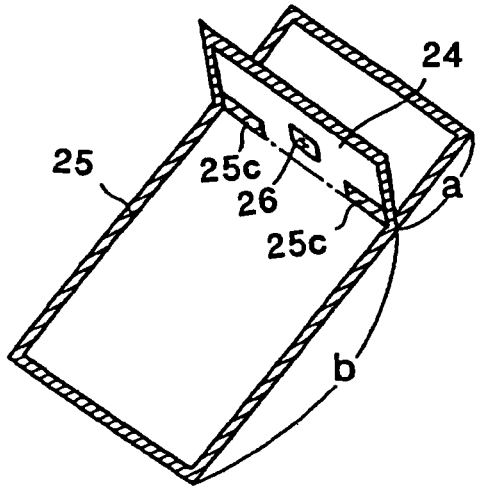
Figure 12B:
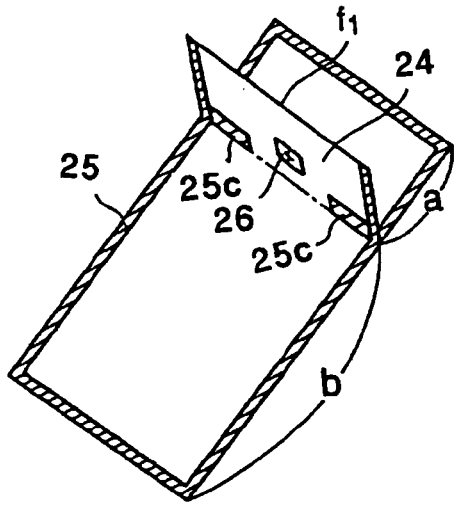
Figure 12C:
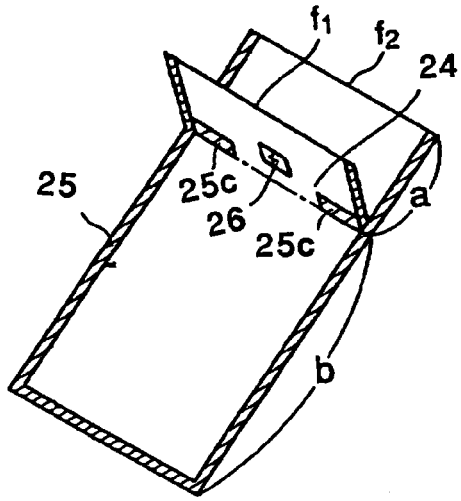
Figure 12D:
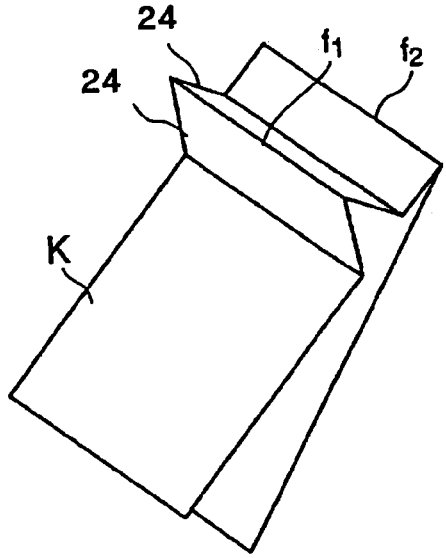
FIG. 12D is a perspective view which explains one constitutive member of the packaging bag.

Another fashion in which the upper member and lower member are formed jointly as one piece as shown in FIGS. 12A–12D can be also adopted. In this fashion, the tail end edge of the wing part may have a seal as shown in FIG. 12A or not have a seal so as to remain as a fold f1 as shown FIG. 12B or 12C. Further, an edge of the main body of the packaging bag may remain as a fold f2 without undergoing a seal.

Then, in the packaging bag 21 for microwave oven heating according to the second embodiment, as shown in FIG. 9A, the point-seal part 26 is formed at the central domain of the above-mentioned wing part. The shape of the point-seal part may be a square, a rectangle, a circle, an ellipse, a triangle, etc., but is not limited thereto. The point seal part may be a part being independent of the main seal part 25 as shown in FIG. 9A, or may be a form connected with the main seal part 25 of the upper side of the wing part 24 as shown in FIG. 9E.

Figure 13A:
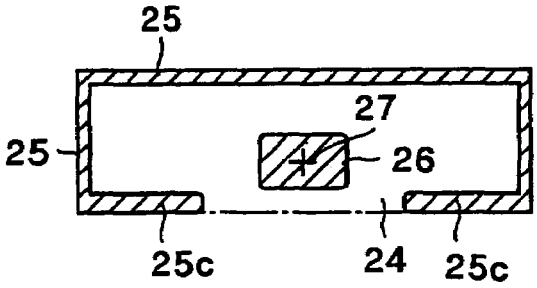
Figure 13B:
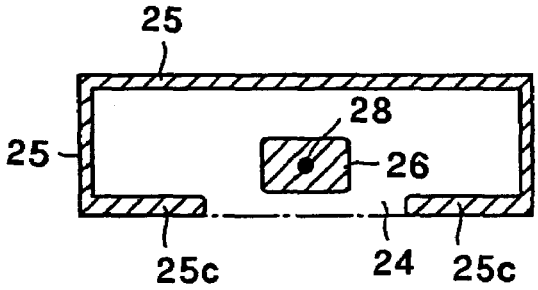
Figure 13C:
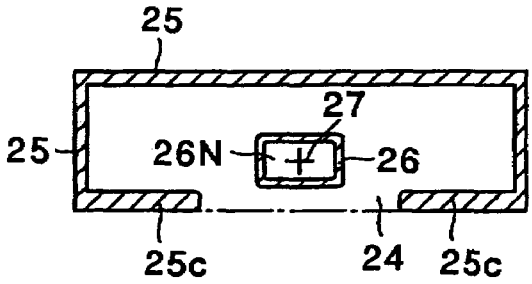
Figure 13D:
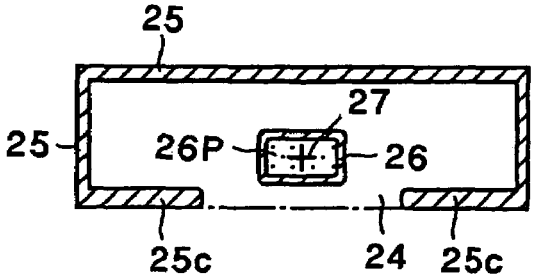

The point-seal part 26 may be formed as solid seal as shown in FIG. 13A and FIG. 13B, or may be formed with surrounding an unsealed part 26N as shown in FIG. 13C, or may be formed with surrounding dotted pattern seal part 26P as shown in FIG. 13D.

Figure 9B:
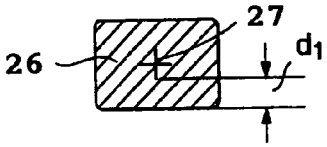
Figure 9C:
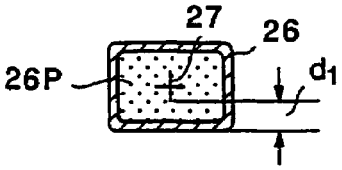
Figure 9D:
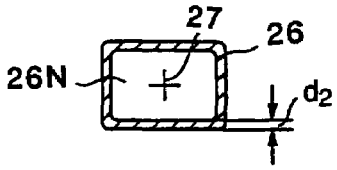
Figure 9E:
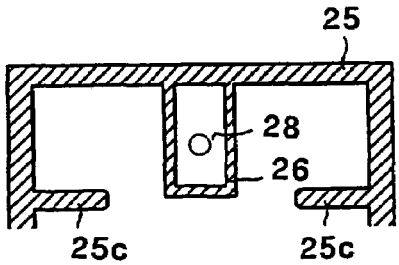

Moreover, the distance d1 between the lower end of the steam permeable means (Figures are the examples of a cut) prepared in the point-seal part 26 and the lower end of the point-seal part 6 in case of the solid seal type point-seal and the type of having the dotted pattern seal part 26P inside of the point seal as shown in FIGS. 9B–9C, and the seal width d2 at the lower side of the point seal part in case of the type of having the unsealed part 26N inside of the point seal are severally desirable in the range of 2–10 mm and more particularly, in the range of 3–7 mm. When the above-mentioned distance d1 or width d2 is smaller than 2 mm, the strength to vibration, falling, etc. will become weak, and a possibility that a bag is damaged during the distribution of products will be raised. Conversely, when larger than 10 mm, a possibility that a steam penetration cannot happen easily and breakage of the bag from other seal parts will take place can be considered.

Figure 9F:
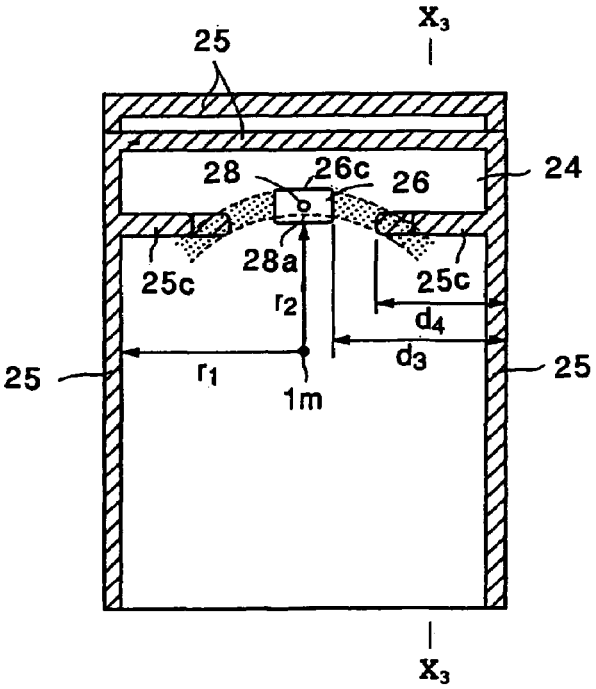
Figure 9G:
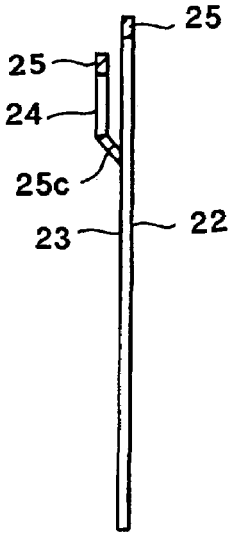

Regarding the position of the point seal part 26, it is preferable that the point-seal part 26 is located at the position that the radius r2 of the circle which touches the lowest end of a point-seal part 26 from the center M in the packaging bag is shorter than the radius r1 of the circle which touches the inner end of the side edge seal part of the bag, when circles are drawn by centering on the center M of the packaging bag as shown in FIG. 9F. When the radius r2 is longer than the radius r1, there is a possibility that exfoliation and regression in the seal part by virtue of the enhanced heat and internal pressure generated by heating may take place in the main seal part at the side of the packaging bag, and the breakage of a packaging bag and leakage of contents may arise.

In the second embodiment of this invention, with respect to the location of the wing part provided in the packaging bag 21 for microwave oven heating, it is desirable to satisfy the condition that the ratio "a/b" of the length "a" between an end edge in the longitudinal direction of the packaging bag and the formation position of the wing part, to the length "b" between the formation position of the wing part and the opposite end edge in the longitudinal direction of the packaging bag as shown in FIG. 9A is in the range of 1/50 to 2/3. When it is within the above range, the force for promoting the exfoliation and regression by heat and enhanced internal pressure will be well applied to the point-seal part 26 provided in the wing part, and thus, automatic opening will be better attained.

Then, as shown in FIG. 9A or FIG. 9E, in addition to the above-mentioned point-seal part 26, control seal parts 25C are provided in the wing part so as to be extended from each side edge seal part of the wing part 24 toward the point-seal part and to be arranged almost in parallel with the tail end edge of the wing part. By preparing this control seal parts 25C, the heat and pressure of steam generated by microwave oven heating can be, applied intensively to the point-seal part 26, and can prevent rapid exfoliation at the point-seal part 26, and bag breakage.

As shown in FIG. 9F, it is preferable that the end of the control seal part 25C on the center side of the bag is located at a position between the circle which touches the lowest end 28*a* of the steam permeable means and the circle which touches the uppermost end 26*c* of the point-seal part, when coaxial circles are drawn by centering on the center of the bag, and the ratio d3/d4 of the length d3 between the side edge of the packaging bag and the side edge of the point-seal part, to the length d4 between the side edge of the packaging bag and the center side end of the control seal part is in the range of 8/7 to 8/3. When the control seal part is extremely short, the pressure will be applied to the point-seal part 26 too much and seal regression will progress at a dash in a point-seal part on heating, and thus, a pop may occur, or a packaging bag may bound, which events cause the user uneasiness. When the control seal part is too long, the pressure will be not applied adequately to the point-seal part 26, which may result in the burst of bag.

Control seal parts 25C can be made into various forms as far as it fulfills the above-mentioned conditions. For example, the control seal part is formed as solid seal. Alternatively, as shown in FIG. 15A–FIG. 15D, the upper area of control seal part is formed with a combination of seal lines each of which may be a straight line and/or a curve so as to embrace predetermined parts to form independent sealed parts R which are isolated from the internal spaces of the packaging bag. The isolated interior space of the independent sealed parts R may be in a non-seal state, or may give a pattern seal.

Furthermore, various steam permeable means may be provided in the independent seal part R. The steam permeable means may be in the same form with those in the aforesaid point-seal parts, or may be different form from those in the aforesaid point-seal parts. In an example shown in FIG. 15A, cuts 28 are provided in the independent seal parts R on both sides.

In case that the steam is generated rapidly due to the fact that the contents stored in the packaging bag has a large volume of moisture, or that the bag is subjected to heating with a high-power microwave oven, the independent seal part R will be opened in addition to the opening of the point seal part 26, and thus the steam permeable means prepared in the independent seal part R will give an effect for stabilizing the steam diffusion and steam escape from the steam permeable means 27 or 28 provided in the point seal part 26. Moreover, the steam permeable means in the independent seal part R functions also as a safety system when getting blocked the steam permeable means 27 or 28 in the point-seal part 26 with the contents, etc.

The point-seal and control seal which are provided in the wing part 24 in the packaging bag of this invention can make substantially the same seal strength with the periphery seal of a packaging bag, while the seal of steam permeable means part in the conventional packaging bag was provided as a weak seal as compared with the periphery seal of the packaging bag. Thus, the packaging bag of this invention has a stable strength during the distribution.

As for the shapes of control seal parts 25C, they are desirable to be formed in axial symmetry with respect to the axis in the longitudinal direction of the bag. If they are asymmetrical, deviation will arise in the degree of pressure which applies to the control seal part 25C or the point-seal part 26, and the phenomenon may induce a possibility that automatic opening may not be attained well.

Figure 15A:
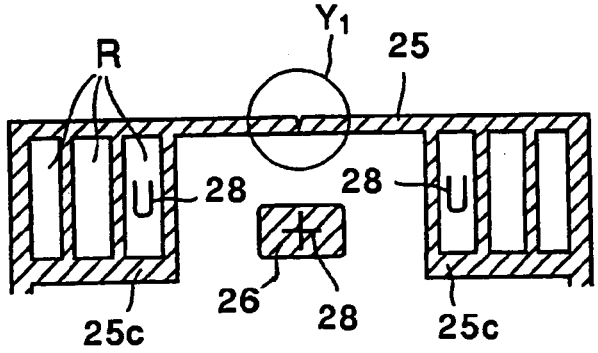
FIGS. 15A–D are drawings which show examples of the shape of the control seal part and an example of notch, provided in the wing part of the packaging bag for microwave oven heating according to the second embodiment of the packaging bag of this invention.
Figure 15B:
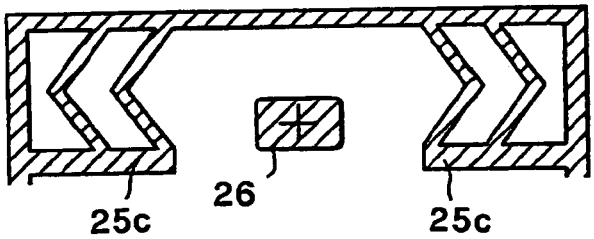
Figure 15C:
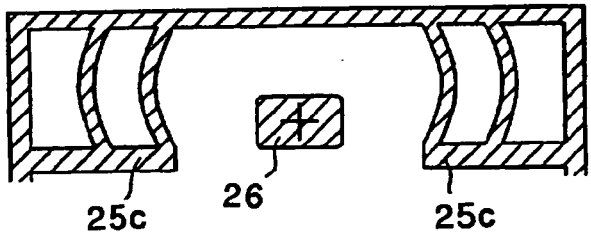
Figure 15D:
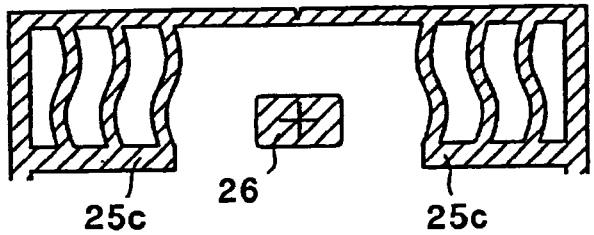
Figure 15E:
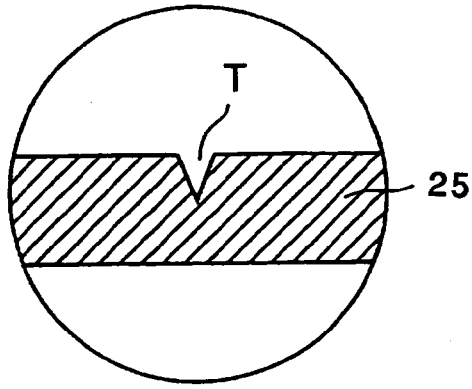
FIG. 15E is the enlarged view of the Y1 part in FIG. 15A.

In the packaging bag of the second embodiment, a seal opening notch T may be provided in the seal part of the tail end edge of the wing part 4 as in the examples shown in FIG. 15A and FIG. 15E. The seal opening notch T is used for making a steam release port in advance of the microwave oven heating, and its shape may be any one of conventionally practicing shapes such as V-shape notch, I-shape notch, U-shape notch, etc. In the packaging bag of this invention, as described above, even if the sealed state of the internal space of the bag is not broken by carrying out tearing the bag or any alternative action in advance of heating, automatic release can be carried out by the aid of the point-seal part and the steam permeable means provided in the wing part, and thus, it is not necessarily to provide such a seal opening notch for the bag of this invention.

In the packaging bag 21 for microwave oven heating according to the second embodiment, although especially the seal strength of the seal part provided in the wing part 24, i.e., the point-seal part and control seal parts, is not limited, it is desirable to be not more than 25N/15 mm width at the temperature of not less than 90° C., and more preferably, not more than 15N/15 mm width at the temperature of not less than 90° C. When the above-mentioned seal strength exceeds 25N/15 mm width, the seal regression may not occur smoothly, and thus, there is a possibility that automatic opening may not be attained. Although especially the state of seal regression is not limited, what is depended on condensation destruction is desirable. Although it is possible to make the difference in the seal strength between the seal parts within the wing part and the periphery seal parts, the necessity of making the difference does not exist in this invention. Because the automatic opening can be attained by the aforementioned configuration of the bag according to this invention form which was described above, even if all seal parts have an equivalent strength.

Next, the layered product which may be used for preparing the packaging bag 21 for microwave oven heating according to the second embodiment is explained. Although the above-mentioned packaging bag 21 may be formed with a single plastic film having heat seal ability, it is desirable that the bag is formed with a layered product which comprises at least a substrate layer 11 and a sealant layer 13 from the standpoints of, such as the bag strength, heat resistance, and contents protection, etc. Since the layered product used in the second embodiment is the same as the layered product described in the first embodiment mentioned above, referring to FIG. 1D and FIG. 1E, further explanation for the second embodiment is omitted.

As described above, since the packaging bag 21 for microwave oven heating according to the second embodiment is provided with a wing part 24 at the upper side thereof, even if it has liquid contents, it can be heated in its horizontal configuration by which the wing part 24 is located at upper side. Further, since the point seal part is established at the central area of the wing part, the steam permeable means is further established within the point seal part, and the control seal parts is established so as to be elongated from the respective side seal parts toward the point seal part, the packaging bag of this embodiment can be heated stably and amply without the explosion of the bag or leakage of the internal fluidal foods.

Furthermore, even if a steam releasing port is not prepared in advance of heating, the bag can be heated without the explosion of the bag, by virtue of the point-seal part and steam permeable means mentioned above.

FIGS. 19A–H show the packaging bag according to the third desirable embodiment of the packaging bag of this invention.

Figure 19A:
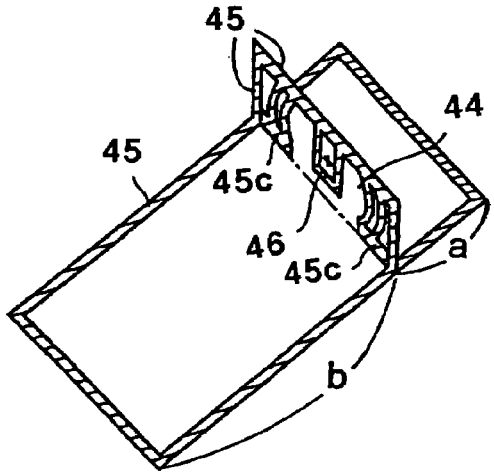

The packaging bag 41 for microwave oven heating according to this third embodiment is a bag which formed the wing part 44 in one side of the main body of a bag, as shown in FIG. 19A. This wing part 44 forms a second internal space S2 which is communicated with a first internal space S1 of the main body of the bag at an end thereof and sealed at other ends thereof.

Figure 19B:
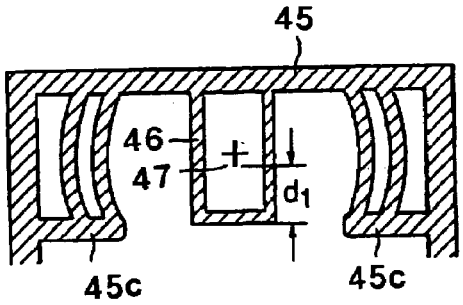

This packaging bag can be heated with a microwave oven in a state of setting as the upper side the face in which the above-mentioned wing part 44 is formed. In the wing part 44, as shown in FIG. 19A–FIG. 19B, the point-seal part 46 and the steam release means 47 are formed. Even if a steam release port is not established in advance of the heating, the steam generated by microwave oven heating can be diffused out from the bag through the steam release means 47, since exfoliation and regression of sealed area of the above-mentioned point-seal part 46 would be caused by virtue of the heat and pressure of the generated steam.

In the packaging bag 41 for microwave oven heating according to the third embodiment, the wing part 44 is formed in the portion located in the upper part when a bag is laid on a plane, as shown in FIG. 19A–FIG. 19B, and the point-seal part 46 is formed in the central area within the domain of this wing part 24 so as to be continuously formed from the seal part or fold part at the tail end edge of the wing part 44, and further the steam release means such as a cut 47 which is similar with the cut 27 as shown in FIG. 14A–FIG. 14C or a hollow 48 which is similar with the hollow 28 as shown in FIG. 14D is formed within the inside region of the point-seal part 46 which is isolated from the internal spaces of the packaging bag by the point-seal. When heating, the heat and pressure generated by heating induce the exfoliation and regression of the point-seal part 46, which is followed by the natural opening of the isolated inside region so as to release the steam through the steam release means 47 or 48. Thus, the breakage of the bag on heating can be prevented. Since the packaging bag 41 of this embodiment can be subjected to microwave oven heating in its horizontal configuration where the wing part 44 is set as the upper side, it can be used for a fluidal food. Namely, on the heating with the microwave oven, automatic opening is produced by the exfoliation and regression of the desired part 46 and the following communication of the internal spaces of the bag with the cut 47 or hollow 48. Thus, without troublesome step for providing an opening cut or the like in advance of heating, the steam generated in the bag can get away from the bag through the communicated cut or hollow. Therefore, the heating operation will become safety. Further, no need for providing an opening cut or the like will give a convenience.

Since the cut 47 or hollow 48 resides in an inner position of the point seal part, the complete sealing performance of the bag during the distribution of products can be ensured.

Further, with respect particularly to the packaging bag 41 for microwave oven heating according to the third embodiment, since the point-seal part 46 is continuously formed from the seal part or fold part at the tail end edge of the wing part 44 as described above, the event that the steam generated on the microwave oven heating passes through a channel formed between the tail end edge of the wing part and the point seal part would not happen, and therefore, the automatic opening is performed smoothly by an effective applying of the pressure to the point-seal part. Also it can prevent that the contents of bag get into the space between the point seal part and the tail end edge of the wing part, thus, it can avoid degrading the appearance of the packaging bag as a commercial products.

Figure 20A:
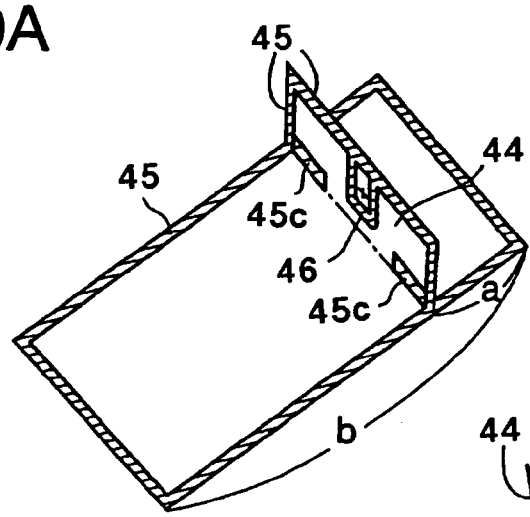
Figure 20B:
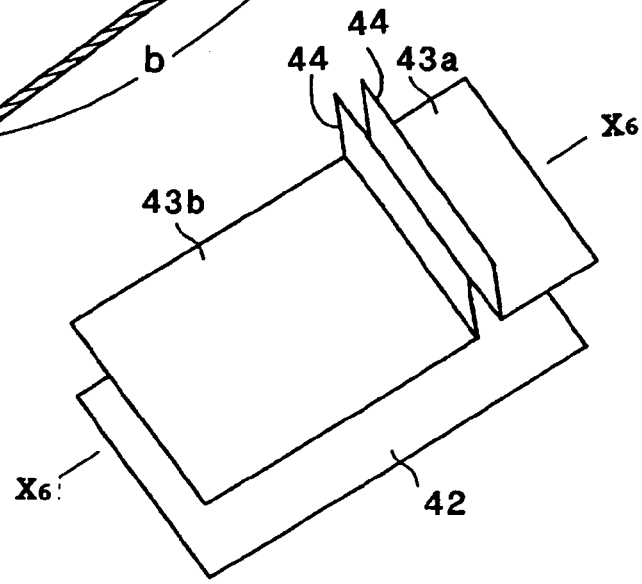
Figure 20C:
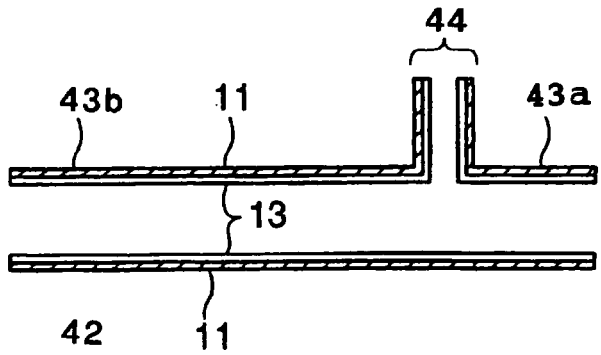

The packaging bag 41 for microwave oven heating according to the third embodiment is a bag using the composite film of which a sealant layer is provided at least one side. As shown in FIG. 20A, FIG. 20B, and FIG. 20C, the bag 41 is manufactured by superposing, onto a lower member 42 which uses the sealant layer 13 as the upper face, upper members 43*a*, 43*b*, wherein portions of the upper members 43*a*, 43*b* forms a wing part 44 by doubling the portions while facing the sealant layers 13*a*, 13*b* thereof mutually, and the remaining portions of the upper members are layered on the lower member 42 so that the sealant layer 13 of the remaining portions is used as the lower face of the upper members to be opposite to the upper face of lower member, and sealing the open edges of superposed members including the open end edges of the wing part so as to form the main seal part 45 for sealing up the bag. Although it is a matter of course, in the state where contents are not stored in the bag, one side or a part of the bag is maintained in its non-seal state, and the seal of this open part is completed after the contents filling.

Figure 21A:
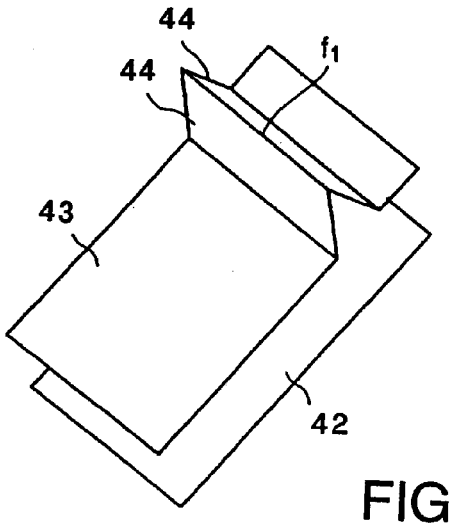
FIG. 21A is a perspective view which explains two constitutive members of the packaging bag in one example.

As shown in FIGS. 20B–20C, in this example, the upper members consist of two pieces. As a fashion of manufacturing the packaging bag with the wing part, however, to form the whole upper member as one piece and shape the wing part 44 by the bending processing as shown in FIG. 21A can be also adopted. In this fashion, the tail end edge of the wing part may have a seal as shown in FIG. 21C or not have a seal so as to remain as a fold f1 as shown FIG. 21D.

Figure 21B:
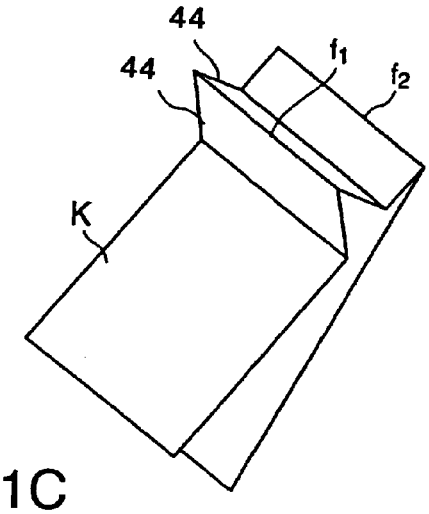
FIG. 21B is a perspective view which explains one constitutive members of the packaging bag in other example.
Figure 21C:
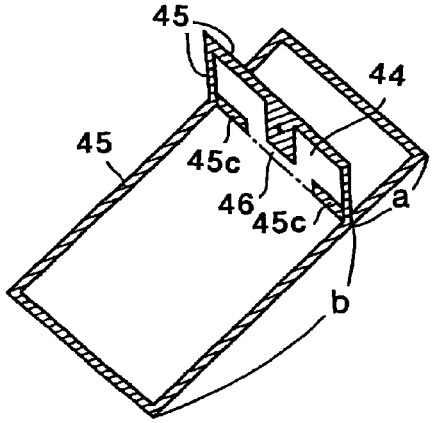
FIG. 21C is a perspective view of the packaging bag.
Figure 21D:
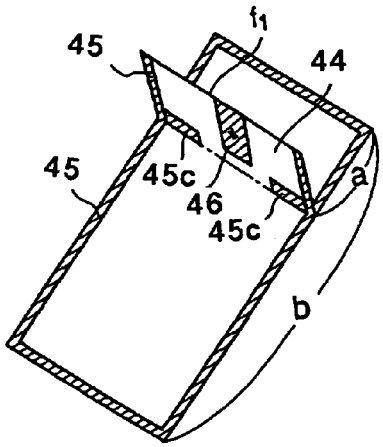
FIG. 21D is a perspective view of another example of the packaging bag.
Figure 21E:
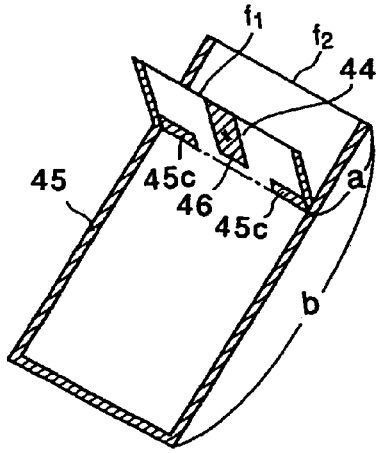
FIG. 21E is a perspective view of another modified example.

Another fashion in which the upper member and lower member are formed jointly as one piece as shown in FIG. 21B can be also adopted. In this fashion, the tail end edge of the wing part may have a seal as shown in FIG. 21C or not have a seal so as to remain as a fold f1 as shown FIG. 21D or 21E. Further, an edge of the main body of the packaging bag may remain as a fold f2 without undergoing a seal.

The shape of the point-seal part 46 may be a square, a rectangle, a circle, an ellipse, a triangle, etc., but is not limited thereto as far as it can be continuously formed from the seal part or fold part at the tail end edge of the wing part 44.

Figure 22A:
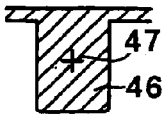
Figure 22B:
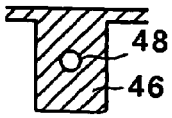
Figure 22C:
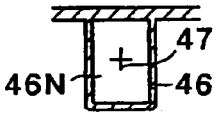
Figure 22D:
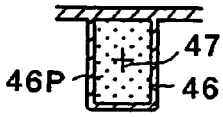
Figure 23A:
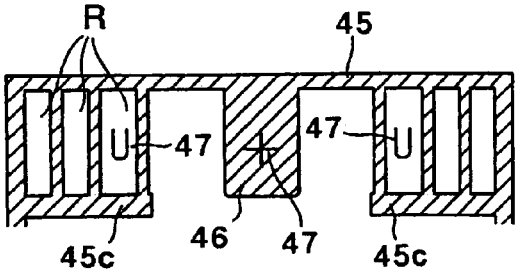
FIGS. 23A–D are drawings which show examples of the shape of the seal part provided in the wing part in the packaging bag for microwave oven heating according to the third embodiment of the packaging bag of this invention.
Figure 23B:
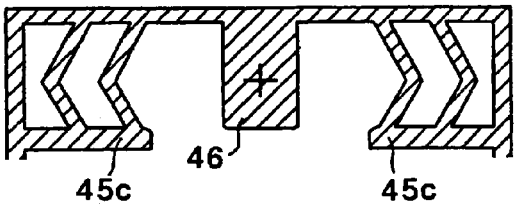
Figure 23C:
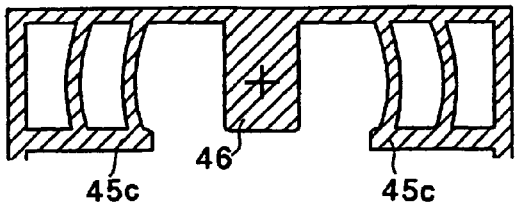
Figure 23D:
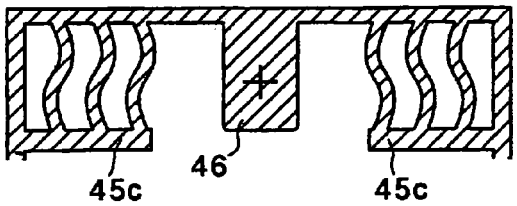

The point-seal part 46 may be formed as solid seal as shown in FIG. 22A and FIG. 22B, or may be formed with surrounding an unsealed part 46N as shown in FIG. 22C, or may be formed with surrounding dotted pattern seal part 46P as shown in FIG. 22D. The pattern of the pattern seal part may be mesh, stripes, lattice, dots, etc., but is not limited thereto.

Figure 19C:
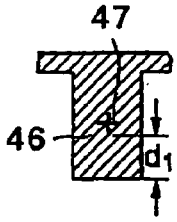
Figure 19D:
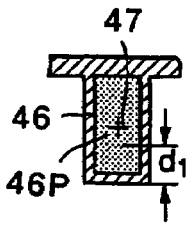
Figure 19E:
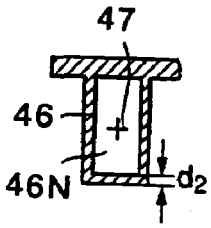

Moreover, the distance d1 between the lower end of the steam permeable means (Figures are the examples of a cut) prepared in the point-seal part 46 and the lower end of the point-seal part 46 in case of the solid seal type point-seal and the type of having the dotted pattern seal part 46P inside of the point seal as shown in FIGS. 19C–19D, and the seal width d2 at the lower side of the point seal part 46 in case of the type of having the unsealed part 46N inside of the point seal 46 are severally desirable in the range of 2–10 mm and more particularly, in the range of 3–7 mm. When the above-mentioned distance d1 or width d2 is smaller than 2 mm, the strength to vibration, falling, etc. will become weak, and a possibility that a bag is damaged during the distribution of products will be raised. Conversely, when larger than 10 mm, a possibility that a steam penetration cannot happen easily and breakage of the bag from other seal parts will take place can be considered.

Figure 19F:
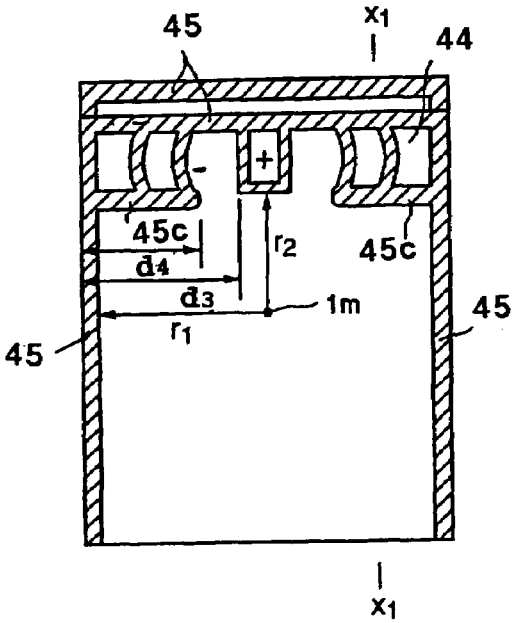
Figure 19G:
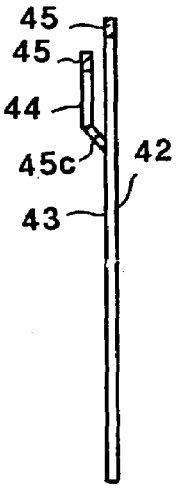
Figure 19H:
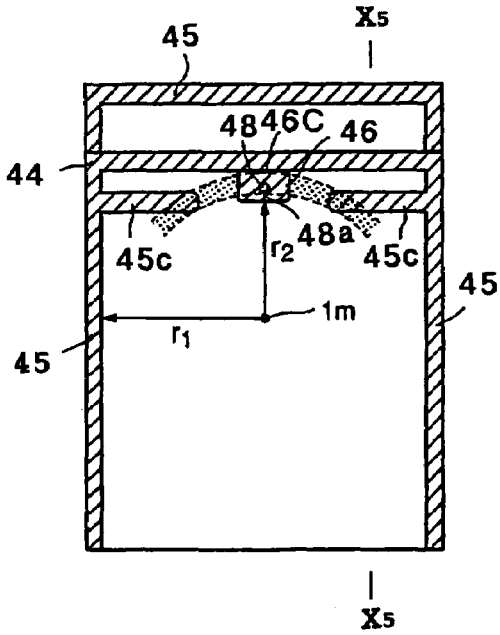

Regarding the position of the point seal part 46, it is preferable that the point-seal part 46 is located at the position that the radius r2 of the circle which touches the lowest end of a point-seal part 46 from the center M in the packaging bag is shorter than the radius r1 of the circle which touches the inner end of the side edge seal part of the bag, when circles are drawn by centering on the center M of the packaging bag as shown in FIG. 19F. When the radius r2 is longer than the radius r1, there is a possibility that exfoliation and regression in the seal part by virtue of the enhanced heat and internal pressure generated by heating may take place in the main seal part at the side of the packaging bag, and the breakage of a packaging bag and leakage of contents may arise.

In the third embodiment of this invention, with respect to the location of the wing part provided in the packaging bag 41 for microwave oven heating, it is desirable to satisfy the condition that the ratio "a/b" of the length "a" between an end edge in the longitudinal direction of the packaging bag and the formation position of the wing part, to the length "b" between the formation position of the wing part and the opposite end edge in the longitudinal direction of the packaging bag as shown in FIG. 19A is in the range of 1/50 to 2/3. When it is within the above range, the force for promoting the exfoliation and regression by heat and enhanced internal pressure will be well applied to the point-seal part 46 provided in the wing part, and thus, automatic opening will be better attained.

Further, with respect to the packaging bag of the third embodiment, as shown in FIG. 19A or FIG. 19F, in addition to the above-mentioned point-seal part 46, control seal parts 45C may be provided in the wing part so as to be extended from each side edge seal part of the wing part 44 toward the point-seal part 46 and to be arranged almost in parallel with the tail end edge of a wing part. However, the control seal parts are not essential for the third embodiment. By preparing this control seal parts 45C, the heat and pressure of steam generated by microwave oven heating can be applied intensively to the point-seal part 46.

As shown in FIG. 19F, it is preferable that the end of the control seal part 45C on the center side of the bag is located at a position between the circle which touches the lowest end 48*a* of the steam permeable means and the circle which touches the uppermost end 46*c* of the point-seal part, when coaxial circles are drawn by centering on the center of the bag, and the ratio d3/d4 of the length d3 between the side edge of the packaging bag and the side edge of the point-seal part, to the length d4 between the side edge of the packaging bag and the center side end of the control seal part is in the range of 8/7 to 8/3. When the control seal part 45C is extremely short, the pressure will be applied to the point-seal part 46 too much and seal regression will progress at a dash in a point-seal part on heating, and thus, a pop may occur, or a packaging bag may bound, which events cause the user uneasiness. When the control seal part 45C is too long, the pressure will be not applied adequately to the point-seal part, which may result in the burst of bag.

Control seal parts 45C can be made into various forms as far as it fulfills the above-mentioned conditions. For example, the control seal part is formed as solid seal. Alternatively, as shown in FIGS. 23A–FIG. 23D, the upper area of control seal part is formed with a combination of seal lines each of which may be a straight line and/or a curve so as to embrace predetermined parts to form independent sealed parts R which are isolated from the internal spaces of the packaging bag. The isolated interior space of the independent sealed parts R may be in a non-seal state, or may give a pattern seal.

Furthermore, various steam permeable means may be provided in the independent seal part R. The steam permeable means may be in the same form with those in the aforesaid point-seal parts, or may be different form from those in the aforesaid point-seal parts. In an example shown in FIG. 23A, cuts 48 are provided in the independent seal parts R on both sides.

In case that the steam is generated rapidly due to the fact that the contents stored in the packaging bag has a large volume of moisture, or that the bag is subjected to heating with a high-power microwave oven, the independent seal part R will be opened in addition to the opening of the point seal part 46, and thus the steam permeable means prepared in the independent seal part R will give an effect for stabilizing the steam diffusion and steam escape from the steam permeable means 47 or 48 provided in the point seal part 46. Moreover, the steam permeable means in the independent seal part R functions also as a safety system when getting blocked the steam permeable means 47 or 48 in the point-seal part 46 with the contents, etc.

The point-seal and control seal which are provided in the wing part 44 in the packaging bag of this invention can make substantially the same seal strength with the periphery seal of a packaging bag, while the seal of steam permeable means part in the conventional packaging bag was provided as a weak seal as compared with the periphery seal of the packaging bag. Thus, the packaging bag of this invention has a stable strength during the distribution.

As for the shapes of control seal parts 45C, they are desirable to be formed in axial symmetry with respect to the axis in the longitudinal direction of the bag. If they are asymmetrical, deviation will arise in the degree of pressure which applies to the control seal part 45C or the point-seal part 46, and the phenomenon may induce a possibility that automatic opening may not be attained well.

In the packaging bag 41 for microwave oven heating according to the third embodiment, although especially the seal strength of the seal part provided in the wing part 44, i.e., the point-seal part and control seal parts, is not limited, it is desirable to be not more than 25N/15 mm width at the temperature of not less than 90° C., and more preferably, not more than 15N/15 mm width at the temperature of not less than 90° C. When the above-mentioned seal strength exceeds 25N/15 mm width, the seal regression may not occur smoothly, and thus, there is a possibility that automatic opening may not be attained. Although especially the state of seal regression is not limited, what is depended on condensation destruction is desirable. Although it is possible to make the difference in the seal strength between the seal parts within the wing part and the periphery seal parts, the necessity of making the difference does not exist in this invention. Because the automatic opening can be attained by the aforementioned configuration of the bag according to this invention form which was described above, even if all seal parts have an equivalent strength.

Next, the layered product which may be used for preparing the packaging bag 41 for microwave oven heating according to the third embodiment is explained. Although the above-mentioned packaging bag 41 may be formed with a single plastic film having heat seal ability, it is desirable that the bag is formed with a layered product which comprises at least a substrate layer 11 and a sealant layer 13 from the standpoints of, such as the bag strength, heat resistance, and contents protection, etc. Since the layered product used in the third embodiment is the same as the layered product described in the first embodiment mentioned above, referring to FIG. 1D and FIG. 1E, further explanation for the third embodiment is omitted.

As described above, since the packaging bag 41 for microwave oven heating according to the third embodiment is provided with a wing part 44 at the upper side thereof, even if it has liquid contents, it can be heated in its horizontal configuration by which the wing part 44 is located at upper side. Further, since the point seal part is established at the central area of the wing part, the steam permeable means is further established within the point seal part, and the control seal parts is established so as to be elongated from the respective side seal parts toward the point seal part, the packaging bag of this embodiment can be heated stably and amply without the explosion of the bag or leakage of the internal fluidal foods.

Furthermore, even if a steam releasing port is not prepared in advance of heating, the bag can be heated without the explosion of the bag, by virtue of the point-seal part and steam permeable means mentioned above.

Figure 25A:
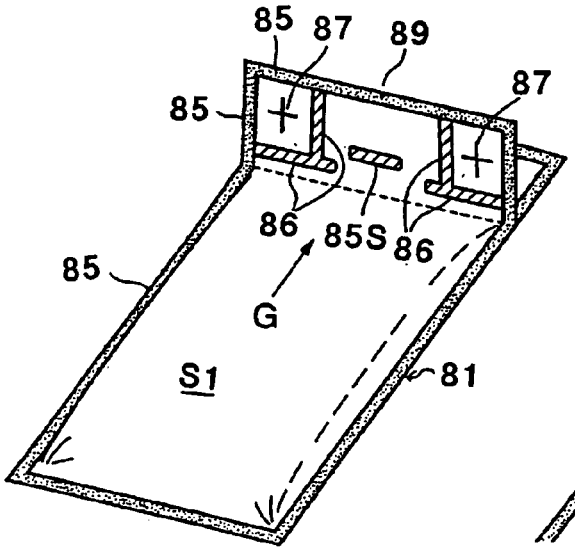
Figure 25D:
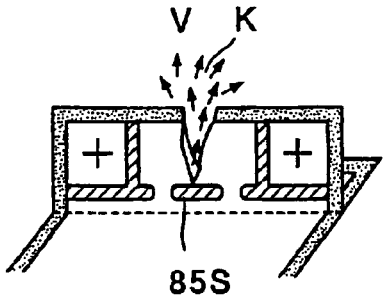

FIGS. 25A–D show the packaging bag according to the fourth desirable embodiment of the packaging bag of this invention. The packaging bag 81 for microwave oven heating according to this fourth embodiment is a bag which formed the wing part 84 in one side of the main body of a bag, as shown in FIG. 25A. This wing part 84 forms a second internal space S2 which is communicated with a first internal space S1 of the main body of the bag at an end thereof and sealed at other ends thereof.

In this wing part 84, an opening notch 89 is formed in the central part of the tail end edge of this wing part 84, and further a tear-stopping seal part 85S is formed at a position which is located in the main body side area of the wing part and is along the axis direction of the notch, i.e., on an extension line of the direction to which the tear will progress when the bag is torn from the above mentioned opening notch. The tear-stopping seal part 85S will function as the tear terminal point when the bag is torn from the above mentioned opening notch in order to prepare a steam release port K. The preparation of a steam release port to be used can be based on other techniques. Furthermore, in this wing part 84, a subseal part 86 as a safety system for opening the seal system is provided, and further the steam release means 87 or 88 is formed in an area which is isolated from the internal spaces of the packaging bag by this subseal part. The subseal part is the seal part which is separate and distinct from the peripheral seal part (main seal part) 85 for the primary seal of the bag, and which is provided at more inner side of the bag than the main seal part so as to form the safety system.

This packaging bag can be heated with a microwave oven in a state of setting as the upper side the face in which the above-mentioned wing part 84 is formed. Even if the preparation of the steam release port K in advance of heating is forgotten, the steam V generated by microwave oven heating can be diffused out from the bag through the steam release means 87 or 88 which will come into communicating state with the interior spaces of the bag, since exfoliation and regression of sealed area of the above-mentioned subseal part 86 would be caused by virtue of the heat and pressure of the generated steam.

Figure 26A:
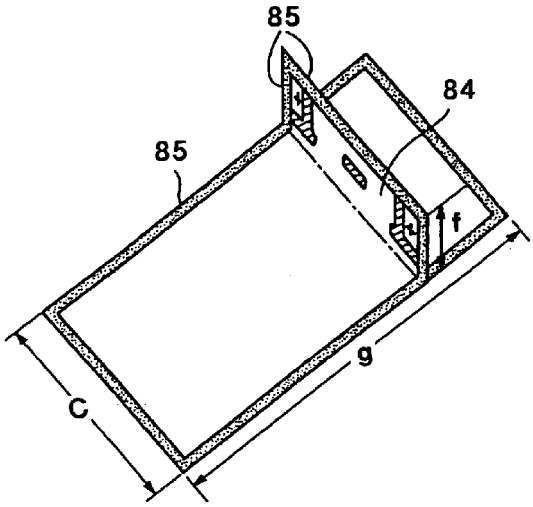
Figure 26B:
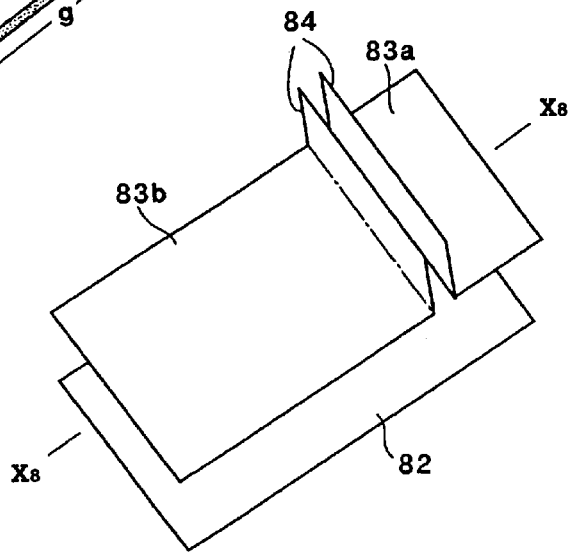
Figure 26C:
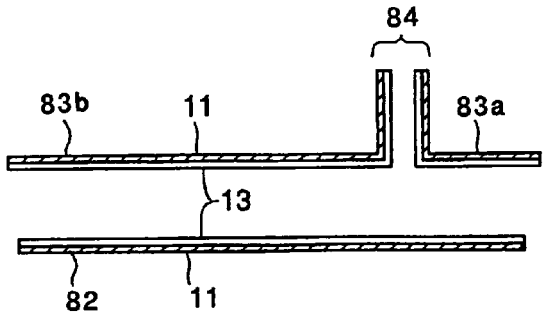

The packaging bag 81 for microwave oven heating according to the fourth embodiment is a bag using the composite film of which a sealant layer is provided at least one side. As shown in FIG. 26A, FIG. 26B, and FIG. 26C, the bag 81 is manufactured by superposing, onto a lower member 82 which uses the sealant layer 13 as the upper face, upper members 83*a*, 83*b*, wherein portions of the upper members 83*a*, 83*b* forms a wing part 84 by doubling the portions while facing the sealant layers 13*a*, 13*b* thereof mutually, and the remaining portions of the upper members are layered on the lower member 82 so that the sealant layer 13 of the remaining portions is used as the lower face of the upper members to be opposite to the upper face of lower member, sealing the open edges of superposed members including the open end edges of the wing part so as to form the main seal part 85 for sealing up the bag, and further providing the safety system which comprises the subseal part 86 and steam release means 87 or 88 which each has a shape and construction as shown in FIGS. 27 A–F, for example, to the wing part. Although it is a matter of course, in the state where contents are not stored in the bag, one side or a part of the bag is maintained in its non-seal state, and the seal of this open part is completed after the contents filling.

Figure 25B:
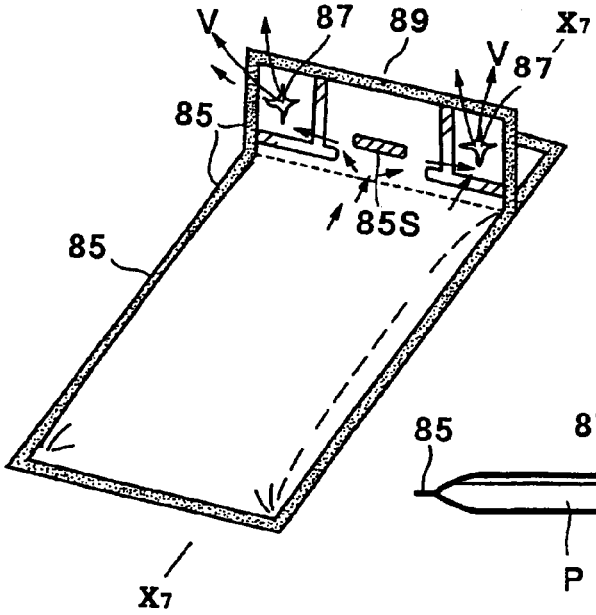
Figure 25C:
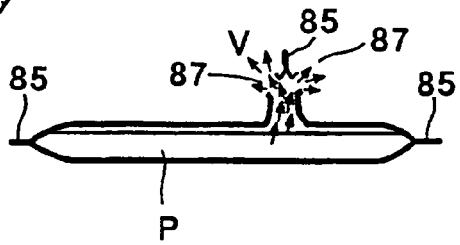

As shown in FIGS. 25B–25C, in this example, the upper members consist of two pieces. As a fashion of manufacturing the packaging bag with the wing part, however, to form the whole upper member as one piece and shape the wing part 44 by the bending processing as described in aforementioned embodiments can be also adopted. Alternatively, another fashion in which the upper member and lower member are formed jointly as one piece can be also adopted.

Incidentally, when contents stored in a sealed bag are subjected to microwave oven heating, usually, the formation of steam release port to the bag is carried out in advance of heating. Since the bag of this embodiment has a notch 89 for opening which is formed the tail end edge of a wing part, for example, it is possible to prepare the steam release port in advance of heating by tearing the bag from this notch 89. Under the present circumstances, in order to prevent an excessive progress of the tearing, the tear-stopping seal part 85S is provided on an extension line of the direction to which the tear will progress. When the bag is torn from the above mentioned opening notch and the tearing comes to the tear-stopping seal port 85S, the bag tends to be hardly torn up since there is a seal area of the seal port 85S. Thus, it is possible to act the seal port 85 as the end point of preparing the steam release port K.

Figure 27A:
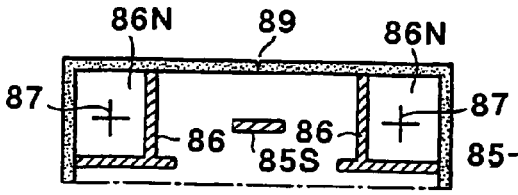
FIGS. 27A–F are views along the G direction shown in FIG. 25A, wherein constructions of the wing part in the other examples according to the fourth embodiment of this invention are shown.
Figure 27D:
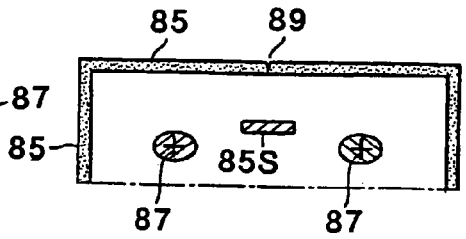
Figure 27B:
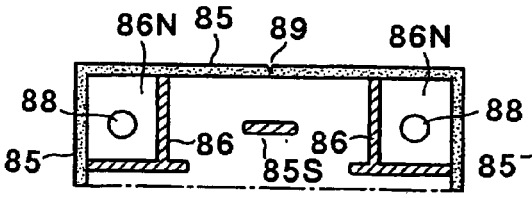
Figure 27E:
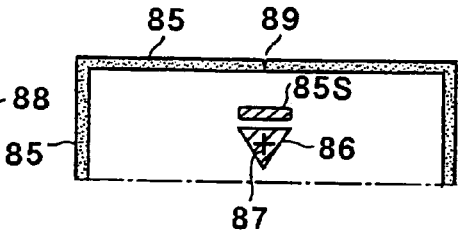
Figure 27C:
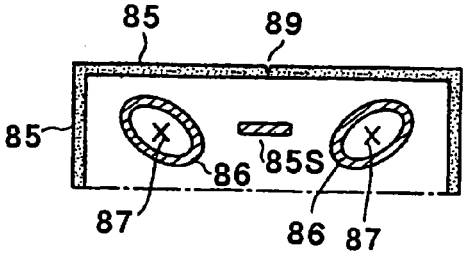

In the packaging bag 81 for microwave oven heating according to the fourth embodiment, as examples of the safety system formed in the wing part 84, as shown in FIG. 27A, FIG. 27B, and FIG. 27C, a constitution that has an unsealed part 86N surrounded by a seal part in the wing part, and further has a cut 87 or hollow 88 formed in the unseal part, may be cited. The seal part which surrounds these unseal part 86N may be formed by the combined use of the main seal part 85 and the subseal part 86, or may be formed by the subseal part 86 alone. As described above, the main seal part 85 is provided for the primary seal of the bag, and the subseal part 86 is the seal part which is separate and distinct from the main seal part 85, and which is provided for the safety system. Incidentally, the main seal part 85 and the subseal part 86 may be heat sealed simultaneously, or heat sealed in another stage.

Then, a steam release means is prepared in the domain of the non-seal part 86N thus formed. The steam release means may be a cut 87, or hollow 88. Since this steam release means is in the portion surrounded by the seal part, it is completely satisfactory to the sealing performance of the internal space of the packaging bag.

Figure 28A:
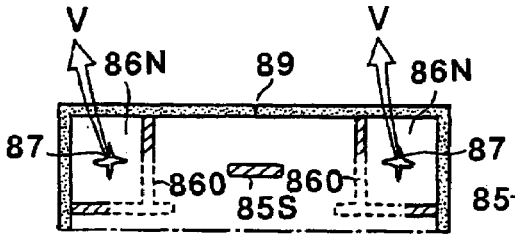
FIGS. 28A–F are schematic views which explain the external steam diffusion in the wing part shown in FIGS. 27A–F, respectively, in the state the steam is generated by heating.

For example, in the example shown in FIG. 27A, as the safety system, the unseal part 86N which is surrounded with the main seal part 85 and the subseal part 86 is formed in the wing part 84, and the cut 87 is prepared in the unseal part 86N. In the example shown in FIG. 27A, as the safety system, two units are formed at right and left sides in the wing part 84. Further, each cut provided inside the respective unseal parts 86N has the cross shape. When the microwave oven heating of this packaging bag is carried out without preparing a steam release port, or when a steam release port prepared in advance of heating is clogged with something such as contents of the bag, etc., during the course of heating, the seal regression will arise at a portion of the subseal part 86, wherein the portion would be in the center side of wing part, as shown in FIG. 28A. As the result, the steam filled in the bag can migrate to the unseal part 86N through the thus formed exfoliation portion 86O of the subseal part, and then, diffuse out from the bag through the cut 87 provided in the unseal part 86N. Thereby, the inner pressure of the packaging bag can be lowered quickly, and which contributes to the avoidance of bursting.

The example shown in FIG. 27B is the same configuration as the example shown in FIG. 27A except having a circular hollow 88 instead of preparing the cut in unseal part 86N.

Figure 28D:
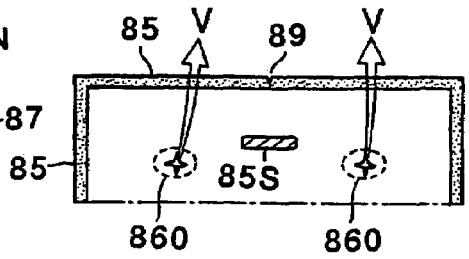
Figure 28B:
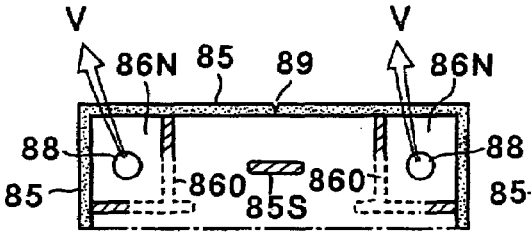
Figure 28E:
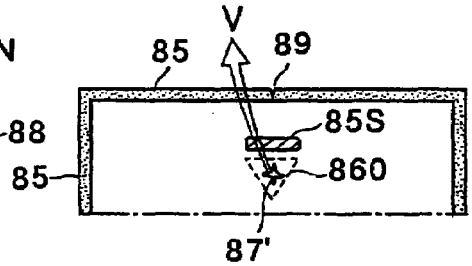
Figure 28C:
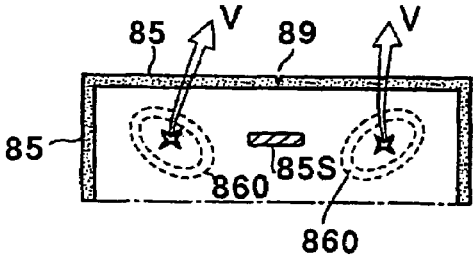

The unseal part 86N can also be surrounded with and formed only in the subseal part 86. For example, in the example shown in FIG. 27C, as a safety system, unseal part 86N surrounded only with the subseal part 86 were formed in the wing part 84, and a cut 87 is provided in this non-seal part 86N. In the example shown in FIG. 27A, the safety system is formed in each right and left side in the wing part 84. With respect to such packaging bags, similarly with that of the aforementioned example, when the microwave oven heating is carried out without preparing a steam release port, or when a steam release port prepared in advance of heating is clogged with something such as contents of the bag, etc., during the course of heating, the seal regression will arise at a portion of the subseal part 86, wherein the portion would be in the center side of wing part, as shown in FIG. 28C. As the result, the steam filled in the bag can migrate to the unseal part 86N through the thus formed exfoliation portion 86O of the subseal part, and then, diffuse out from the bag through the cut 87 provided in the unseal part 86N. Thereby, the inner pressure of the packaging bag can be lowered quickly, and which contributes to the avoidance of bursting.

Further, with respect to the safety system in the packaging bag of the fourth embodiment, a heat seal part as the subseal part 86 in the wing part 84 may be prepared as a form in the nature of the above mentioned point-seal, and in the domain within the point-seal a steam release means may be prepared. For example, in the example shown in FIG. 27D, two subseal parts 86 in the point-seal form are provided in right and left sides of the wing part, and cuts 87 are provided in the respective subseal parts 86. In another example shown in FIG. 27E, a subseal part 86 in the point-seal form and made into triangular form was formed in the wing part, and a cut 87 is provided in the subseal parts 86. In each example, when the microwave oven heating is carried out without preparing a steam release port, or when a steam release port prepared in advance of heating is clogged with something such as contents of the bag, etc., during the course of heating, the exfoliation of the subseal part 86 would be caused by virtue of the heat and pressure of the generated steam, as shown schematically in FIG. 28D and FIG. 28E. As the result, the interior of the bag can be communicated with the embraced atmosphere at the cut 87 opened with the exfoliation portion 86O of the subseal part, and the steam filled in the bag can diffuse rapidly out from the bag through the cut 87. Thereby, the inner pressure of the packaging bag can be lowered quickly, and which contributes to the avoidance of bursting.

Figure 27F:
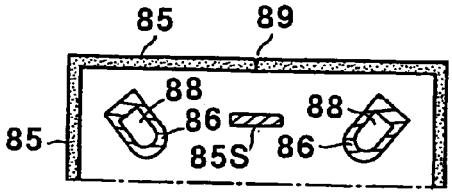
Figure 28F:
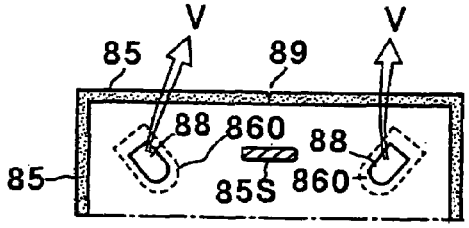

Alternatively, as shown in FIG. 27F, a heat seal part as the subseal part 86 in the wing part 84 may be prepared as a form which has a certain enlarged outside diameter as compared with the above mentioned point-seal, and in the domain within the subseal part a hollow 88 may be provided. In this example, similarly with above examples, when the microwave oven heating is carried out without preparing a steam release port, or when a steam release port prepared in advance of heating is clogged with something such as contents of the bag, etc., during the course of heating, the exfoliation of the subseal part 86 would be caused by virtue of the heat and pressure of the generated steam, as shown schematically in FIG. 28F. As the result, the interior of the bag can be communicated with the embraced atmosphere at the hollow 88 opened with the exfoliation portion 86O, and the steam filled in the bag can diffuse rapidly out from the bag through the hollow 88. Thereby, the inner pressure of the packaging bag can be lowered quickly, and which contributes to the avoidance of bursting.

As described above, the function of the safety system in the packaging bag according to the fourth embodiment is that when the packaging bag to which contents have been stored in sealed condition is subjected to the microwave oven heating without preparing a steam release port, or when a steam release port prepared in advance of heating is clogged during the course of heating, since the pressure of the steam generated by heating which acts as the force for exfoliation of seal will be applied, at first, to any portion projected inwardly of the subseal part 86 which is located at inner side of the bag, rather than the main seal part for peripheral edge sealing while the steam expands the bag, the seal area of such portions in the subseal part regresses gradually so that in the end this event brings the internal spaces of the bag to the state of communicating with the unseal part 86N, at the state the steam V filled in the bag becomes capable of migrating to the unseal part 86N and diffusing out from the bag through the steam release means 87 or 88. Thus, the packaging bag can be heated amply without causing an acute bursting by the inner pressure of the bag.

In the packaging bag of the fourth embodiment, with respect to the position, shape, etc., of the point-seal as the subseal part, or the position, shape, etc., of the steam release means, it is possible to apply conditions which are described in detail for the packaging bag of the first to the third embodiments mentioned above. Further, it is also possible to provide the packaging bag of this embodiment the side seal part which is described for the packaging bag of the second and third embodiments.

Next, the layered product which may be used for preparing the packaging bag 81 for microwave oven heating according to the fourth embodiment is explained. Although the above-mentioned packaging bag 81 may be formed with a single plastic film having heat seal ability, it is desirable that the bag is formed with a layered product which comprises at least a substrate layer 11 and a sealant layer 13 from the standpoints of, such as the bag strength, heat resistance, and contents protection, etc. Since the layered product used in the fourth embodiment is the same as the layered product described in the first embodiment mentioned above, referring to FIG. 1D and FIG. 1E, further explanation for the third embodiment is omitted.

As described above, since the packaging bag 81 for microwave oven heating according to the fourth embodiment is provided with a wing part 84 at the upper side thereof, even if it has liquid contents, it can be heated in its horizontal configuration by which the wing part is located at upper side. Further, since the steam releasing port is established at the tail end edge of the wing part which will be located at upper side when the bag is in its horizontal configuration, the packaging bag of this embodiment can be heated stably and amply without the explosion of the bag or leakage of the internal fluidal foods.

In addition, even if a steam releasing port is not prepared in advance of heating, or if the port formed in advance of heating is clogged by a certain reason, the bag can be heated without the explosion of the bag, by virtue of the safety system mentioned above.

Next, the packaging container according to the fifth embodiment of this invention is explained.

The packaging container according to the fifth embodiment comprises the packaging bag according to one of the above mentioned first to fourth embodiments and a casing box for storing the bag, wherein the box has an prearranging portion capable of forming an opening, at the position that the wing part of the packaging bag installed therein is located, wherein the opening is that for pulling out the wing part to the outside of the box.

Figure 30A:
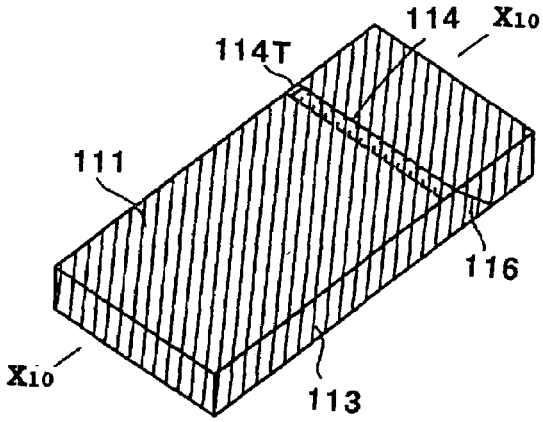
Figure 30B:
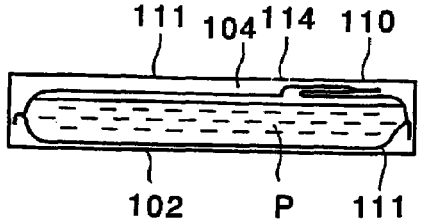
Figure 31:
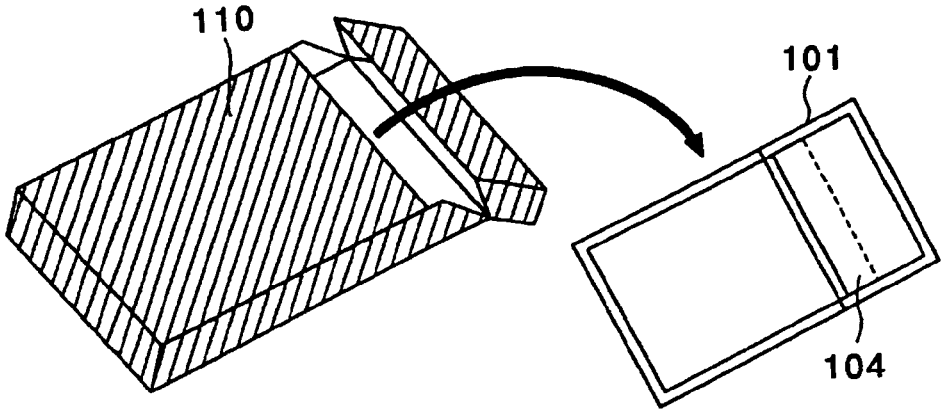
FIG. 31 is a schematic view which shows the state of taking out the packaging bag from the opened casing box in which the packaging bag has been stored.
Figure 32:
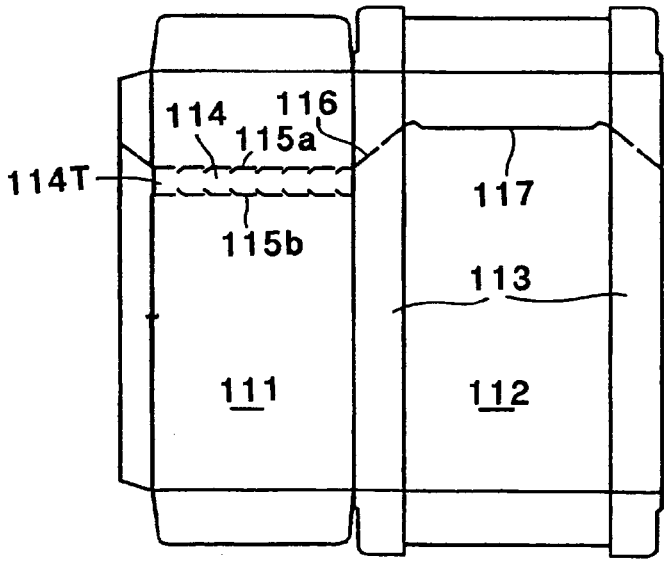
FIG. 32 is a development of an example of the casing box used in the packaging container according to this invention.

The casing box 110 in the packaging container W according to the fifth embodiment, for example, may be a box which has a zipper part 114 in the upper face 111 thereof, as shown in FIG. 30A. When breaking and getting rid of this zipper part 114, a slit 114S can be formed onto the upper face of the box. Further, when pulling the slit 114 in the width direction of the slit while grasping the both edges of the slit, the side faces 113 of the box are split at the cutting line part 116 provided in the side face in advance so as to take the packaging bag 101 stored therein out from the box easily, as shown in FIG. 31. The blank for fabricating such a box is as being shown in FIG. 32. In this figure, numerals 112, 114T, 115 and 117 denotes the bottom face, a zipper knob part, slitting lines, and a fold line, respectively.

Figure 29A:
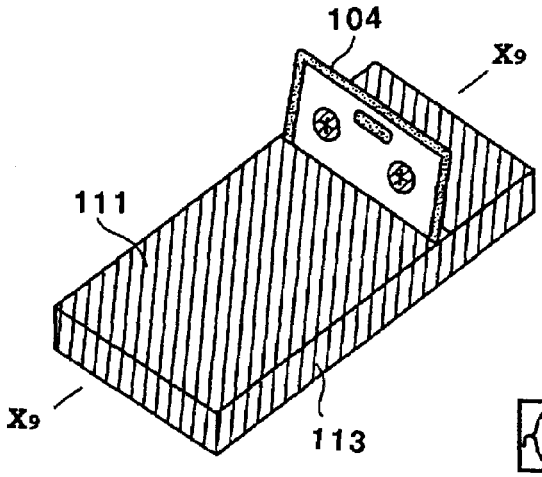
Figure 29B:
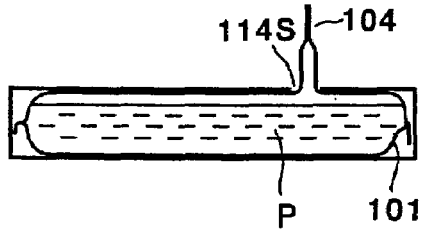

When preparing the microwave oven heating, by taking the packaging bag 101 out from the casing box 110 on a temporary, putting up the wing part 104 of the bag, restoring the bag in the box, and returning the opening, the wing part 104 can protrude from the casing box, and it can hold at an upper site over the casing box as shown in FIG. 29A and FIG. 29B.

Figure 33A:
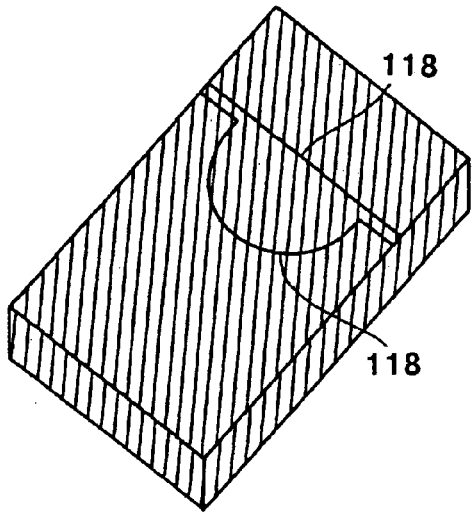
Figure 33B:
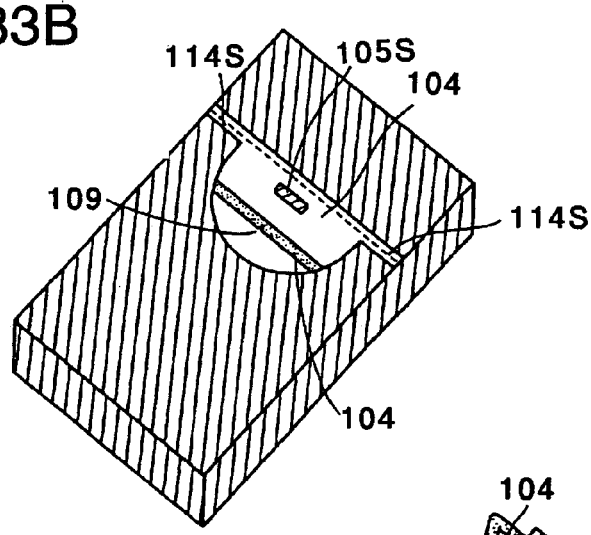
Figure 33C:
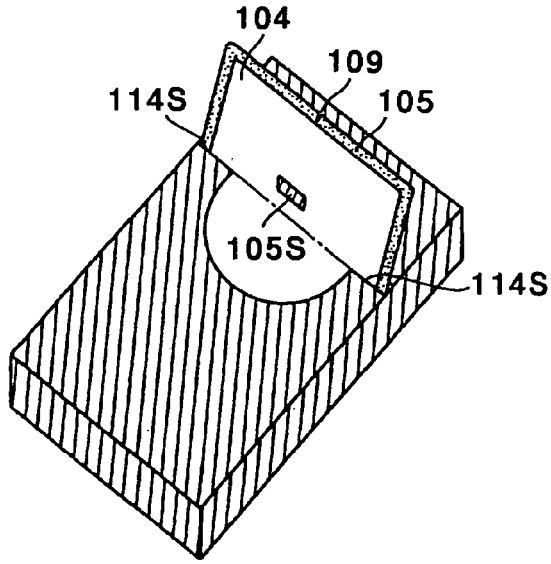

Alternatively, as the casing box, a constitution which is provided with a perforation 118 which can cut off and form the domain (hereinafter, it is referred to as "window part".) of the shape which is sufficient size to pick up the wing part 104 of the packaging bag installed in the box from the outside of the box, and which can form the slit part 114S capable of pinching both sides of the wing part, as shown in FIGS. 33A–C, may be adopted.

FIG. 33B shows the state where the window part is cut off, and where the wing part 104 of the packaging bag is exposed to the exterior, by the formed window part. Then, by pulling up the wing part from the exterior and inserting its both sides into the slit part 114S with narrow width, as shown in FIG. 33C, the wing part 104 can be stood to the upper site over the box, and can be held as this condition.

Incidentally, as the packaging bag installed in the casing box 110 of the packaging container W according to the fifth embodiment, any embodiment of the packaging bag of this invention which comprises the wing parts, involving the aforementioned packaging bags according to the first to the fourth embodiments can be used.

As described above, the packaging container according to the fifth embodiment of the invention can be heated as-is without transferring the contents to another container. Since it has the casing box, its handling in a heated state can be improved, as compared with the packaging bag alone. Moreover, since it can be heated in its horizontal configuration, there is no need to worry about the scattering of the content over inside of microwave oven, or over other places by causing the container to topple over when removing the container out of the oven. In addition, since the packaging bag has the wing part which has structure mentioned above, the packaging container can use suitably as that for food with fluidity, such as liquid, etc.

Although this invention was described as above based on some desirable embodiments, this invention is not limited to these embodiments at all, and persons who are skilled in this arts can understood easily that various changes and modifications are possible within the scope and spirit of this invention which are limited only by the annexed claims.

EXAMPLES

This invention is hereafter explained more concretely based on the following examples. The following examples are, however, given only for the purpose for making the understanding of this invention easy, and do not limit this invention at all.

Example 1

Figure 6A:
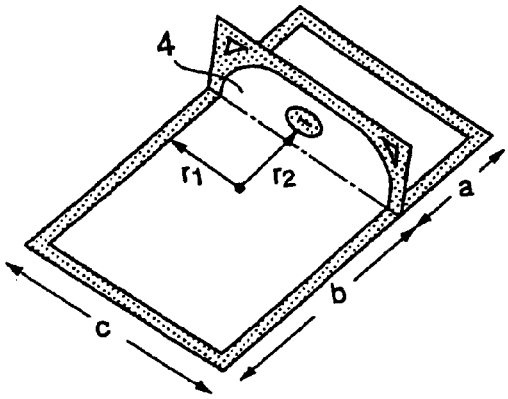
Figure 6B:
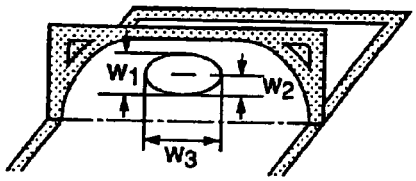

The bag of the shape as shown in FIGS. 6A–B was prepared by using a packing material which had been manufactured by dry lamination of an alumina deposited polyethylene terephthalate film with a thickness of 12 μm, a 15 μm oriented nylon film, and a 60 μm non-oriented polypropylene film. The size of each part shown in FIG. 6 was set as follows.

a=50 mm, b=150 mm, c=150 mm
r1=65 mm, r2=55 mm
w1=10 mm, w2=5 mm, w3=15 mm.

Curry was injected into the obtained packaging bag, and after sealing, the bag was subjected to heating with 500 W microwave oven. As a result of this heating, steam escaped from the slit 7 calmly after about 2 minutes. Since steam escaped from the upper part of the bag, no boiloff was observed.

Control 1

The bag was prepared as in the case of Example 1 except not forming a steam permeable means in the point-seal part 6. Curry was injected into the obtained packaging bag, and after sealing, the bag was subjected to heating with 500 W microwave oven. As a result of this heating, the side seal part in the bag was torn, and the bag was exploded with a loud sound, and the contents in the bag were scattered over.

Referential Example 1

Figure 7A:
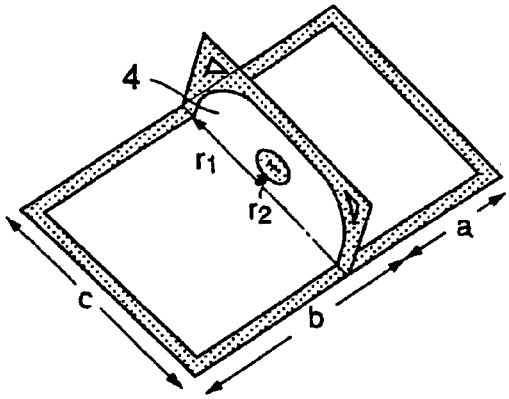
Figure 7B:
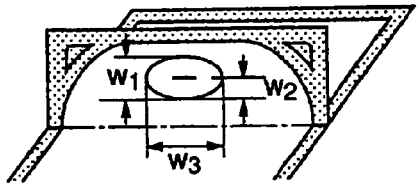

The bag was prepared as in the case of Example 1 except the shape of the bag was changed to that shown in FIGS. 7A–B. The size of each part shown in FIG. 7 was set as follows.

a=100 mm, b=100 mm, c=150 mm,
r1=65 mm, r2=55 mm,
w1=10 mm, w2=5 mm, w3=15 mm.

Curry was injected into the obtained packaging bag, and after sealing, the bag was subjected to heating with 500 W microwave oven. As a result of this heating, the side seal part in the bag was torn, and the bag was exploded with a loud sound, and the contents in the bag were scattered over.

Referential Example 2

Figure 8A:
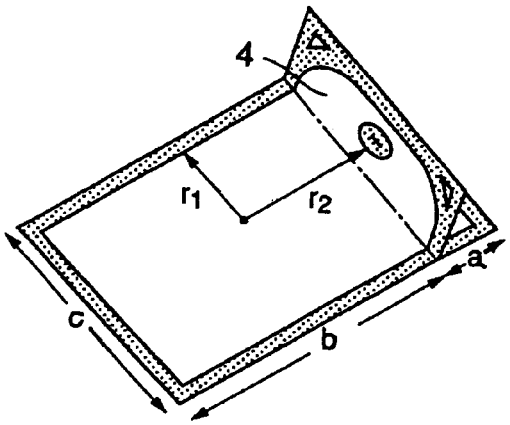
Figure 8B:
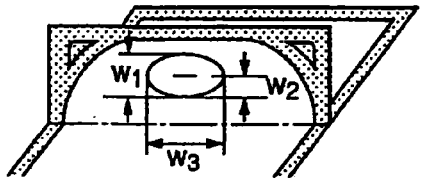

The bag was prepared as in the case of Example 1 except the shape of the bag was changed to that shown in FIGS. 8A–B. The size of each part shown in FIG. 8 was set as follows.

a=30 mm, b=170 mm, c=150 mm,
r1=65 mm, r2=75 mm,
w1=10 mm, w2=5 mm, w3=15 mm.

Curry was injected into the obtained packaging bag, and after sealing, the bag was subjected to heating with 500 W microwave oven. As a result of this heating, steam escaped from the cut 7 calmly after about 2 minutes. Since steam escaped from the upper part of the bag, no boiloff was observed.

Example 2

Figure 16A:
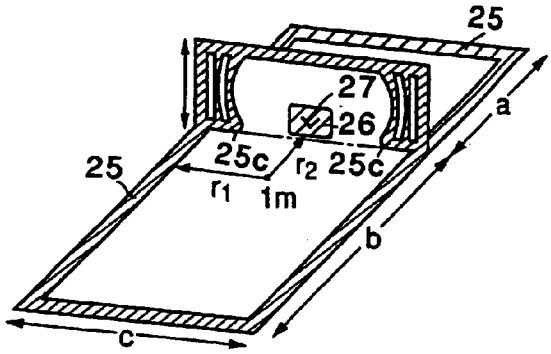
FIG. 16A is a whole configuration view and FIG. 16B is a principal part configuration view showing a wing part.
Figure 16B:
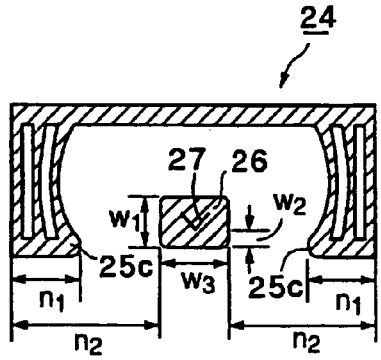

The bag of the shape as shown in FIGS. 16A–B was prepared by using a packing material which had been manufactured by dry lamination of an alumina deposited polyethylene terephthalate film with a thickness of 12 μm, a 15 μm oriented nylon film, and a 60 μm non-oriented polypropylene film. The size of each part shown in FIG. 16 was set as follows.

a=50 mm, b=150 mm, c=150 mm
r1=65 mm, r2=55 mm
w1=10 mm, w24=5 mm, w3=15 mm,
n1=50.5 mm, n2=65.5 mm.

Curry was injected into the obtained packaging bag, and after sealing, the bag was subjected to heating with 500 W microwave oven. As a result of this heating, steam escaped from the cut 7 calmly after about 2 minutes. Since steam escaped from the upper part of the bag, no boiloff was observed.

Referential Example 3

Figure 17A:
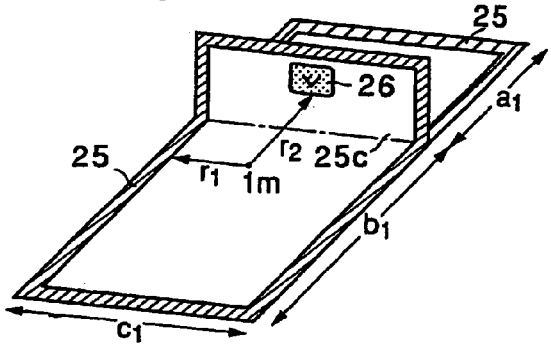
FIG. 17A is a whole configuration view and FIG. 17B is a principal part configuration view showing a wing part.
Figure 17B:
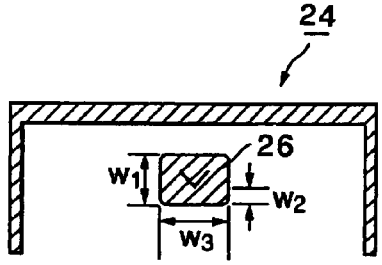

The bag of the shape as shown in FIGS. 17A–B having no control seal part was prepared by using a packing material which had been manufactured by dry lamination of an alumina deposited polyethylene terephthalate film with a thickness of 12 μm, a 15 μm oriented nylon film, and a 60

μm non-oriented polypropylene film. The size of each part shown in FIG. 17 was set as follows.

a=50 mm, b=150 mm, c=150 mm r1=65 mm, r2=70 mm w1=10 mm, w2=5 mm, w3=15 mm.

Curry was injected into the obtained packaging bag, and after sealing, the bag was subjected to heating with 500 W microwave oven. As a result of this heating, the main seal part at the side edge exploded previously after about 2 minutes, and the curry, i.e., contents in the bag were scattered over interior of the oven.

Referential Example 4

Figure 18A:
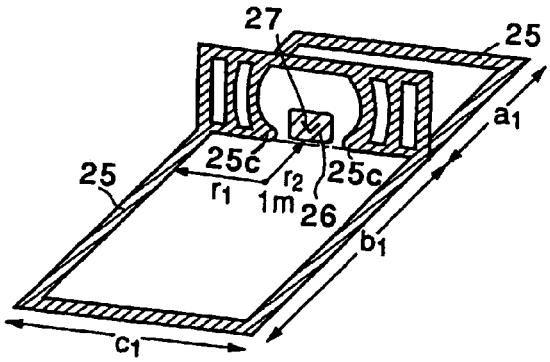
FIG. 18A is a whole configuration view and FIG. 18B is a principal part configuration view showing a wing part.
Figure 18B:
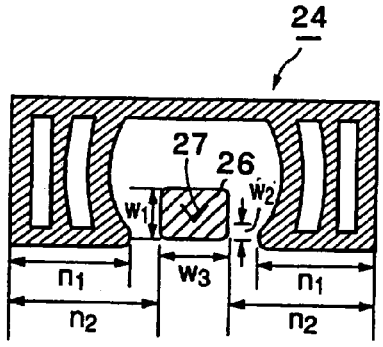

The bag of the shape as shown in FIGS. 18A–B was prepared by using a packing material which had been manufactured by dry lamination of an alumina deposited polyethylene terephthalate film with a thickness of 12 μm, a 15 μm oriented nylon film, and a 60 μm non-oriented polypropylene film. The size of each part shown in FIG. 17 was set as follows.

a=50 mm, b=150 mm, c=150 mm r1=65 mm, r2=55 mm w1=10 mm, w2=5 mm, w3=15 mm, n1=65 mm, n2=70 mm.

Curry was injected into the obtained packaging bag, and after sealing, the bag was subjected to heating with 500 W microwave oven. As a result of this heating, the main seal part at the side edge exploded, and the curry, i.e., contents in the bag were scattered over interior of the oven.

Example 3

Figure 24:
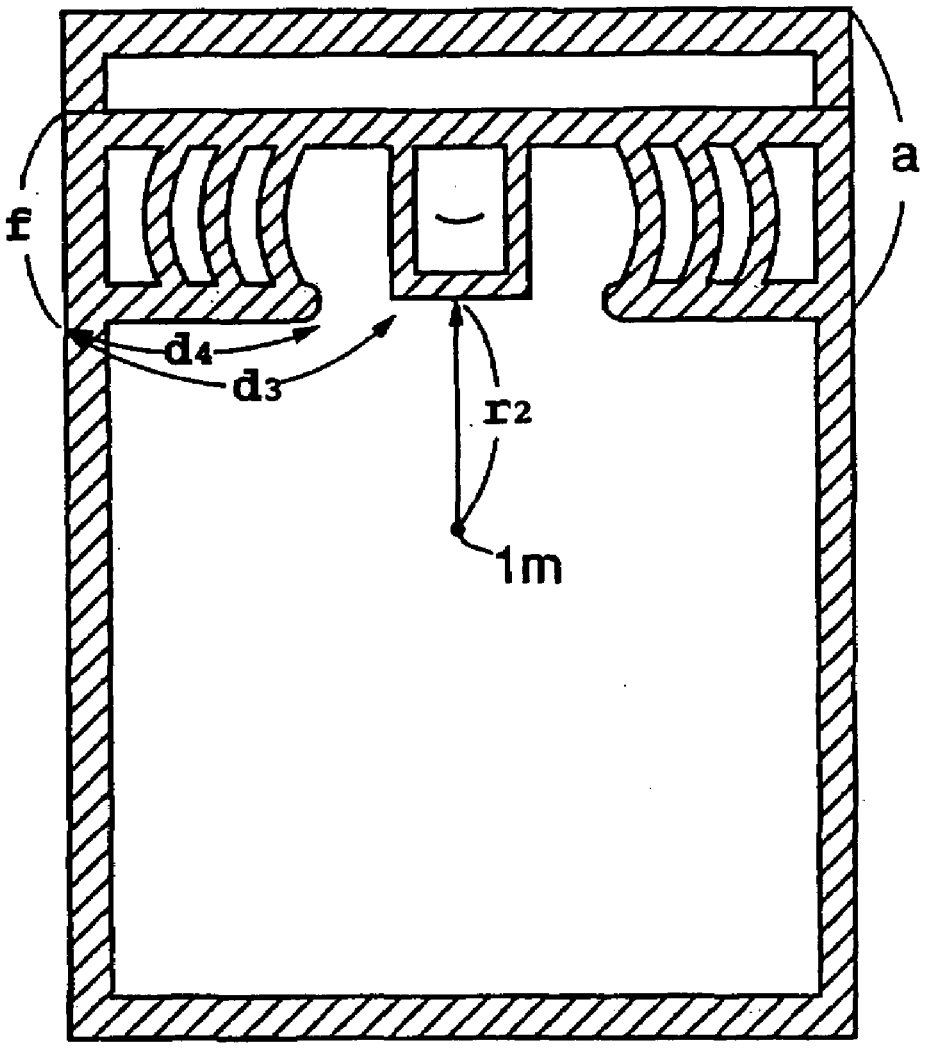
FIG. 24 is a whole configuration view which explains the shape of the packaging bag in an Example mentioned later according to the third embodiment of the packaging bag of this invention.

The bag of the shape as shown in FIG. 24 was prepared by using a packing material which had been manufactured by dry lamination of a silica deposited polyethylene terephthalate film with a thickness of 12 μm, a 15 μm oriented nylon film, and a 60 μm non-oriented polypropylene film. The size of each part shown in FIG. 24 was set as follows.

a=50 mm, f=25 mm, r2=40 mm, d3=60 mm, d4=40 mm.

Curry was injected into the obtained packaging bag, and after sealing, the bag was subjected to heating with 500 W microwave oven. As a result of this heating, steam escaped from the cut 7 calmly after about 2 minutes. Since steam escaped from the upper part of the bag, no boiloff was observed.

Example 4

The bag of the shape as shown in FIG. 26A was prepared by using a packing material which had been manufactured by dry lamination of an alumina deposited polyethylene terephthalate film with a thickness of 12 μm, a 15 μm oriented nylon film, and a 60 μm non-oriented polypropylene film. The size of each part shown in FIG. 26 was set as follows.

a=50 mm, f=25 mm, g=200 mm.

The seal width of the main seal part was set to 7 mm. Moreover, the configuration of the safety system formed in the wing part was the shape shown as FIG. 27A.

120 g of Curry was injected into the obtained packaging bag, and then the bag was sealed. Thereafter, a steam release port was formed by tearing the bag from the notch 89, then the bag was put into a 500 W microwave oven in its in its horizontal configuration where the wing part 84 was located at upper site, and was subjected to heating. As a result of this heating, steam escaped from the steam release port provided at the wing part calmly after about 1 minute. Since steam escaped from the upper part of the bag, no boiloff was observed.

Moreover, as a result of heating with a microwave oven on the same conditions as above except not forming a steam release port, the subseal part of a wing part regressed, steam fell out from the cut prepared in the non-seal part surrounded by the seal part, and thus a burst of bag and scattering of the contents did not take place.

Control 2

The same bag as in the case of Example 4 except the safety system was not provided was prepared by using a packing material which had been manufactured by dry lamination of an alumina deposited polyethylene terephthalate film with a thickness of 12 μm, a 15 μm oriented nylon film, and a 60 μm non-oriented polypropylene film. The size of each part shown in FIG. 26 was set as follows.

120 g of Curry was injected into the obtained packaging bag, and then the bag was sealed. Thereafter, a steam release port was formed by tearing the bag from the notch 89, then the bag was put into a 500 W microwave oven in its in its horizontal configuration where the wing part 84 was located at upper site, and was subjected to heating. As a result of this heating, steam escaped from the steam release port provided at the wing part calmly after about 1 minute. Since steam escaped from the upper part of the bag, no boiloff was observed.

However, as a result of heating with a microwave oven on the same conditions as above except not forming a steam release port, the side seal part in the bag was torn, and the bag was exploded with a loud sound, and the contents in the bag were scattered over.

Example 5

The packaging bag of the same shape as Example 1 was fabricated by using the packing material which had been manufactured by dry lamination of an oriented nylon film with a thickness of 15 μm and the 60 μm straight chain low density polypropylene film.

180 g of shark fin soup was injected into this packaging bag and the bag was sealed. The bag was put into the casing box as shown in FIG. 33A. Then, as shown in FIG. 33B, the window part was cut off along with perforations. The exposed wing part 104 of the packaging bag was pulled up and inserted into the slit part 114S in order to make the wing part erect.

As a result of heating this packaging container with 500 W microwave oven, steam escaped calmly from the cut part prepared in the point-seal parts of the wing part after 1 minute and 30 seconds. Since steam escaped from the upper part of the bag, no boiloff was observed. Moreover, since it took out from the microwave oven the whole box after heating, it did not feel so hotly.

Example 6

The packaging bag of the same shape as Example 4 (140 mm×180 mm) was fabricated by using the packing material which had been manufactured by dry lamination of an alumina deposited polyethylene terephthalate film with a thickness of 12 μm, a 15 μm oriented nylon film, and a 60 μm non-oriented polypropylene film.

180 g of curry was injected into this packaging bag and the bag was sealed. The bag was put into the casing box as shown in FIG. 33A. Then, as shown in FIG. 33B, the window part was cut off along with perforations. The exposed wing part 104 of the packaging bag was pulled up and inserted into the slit part 114S in order to make the wing part erect.

As a result of heating this packaging container with 500 W microwave oven, steam escaped calmly from the cut part prepared in the point-seal parts of the wing part after 1 minute and 40 seconds. Since steam escaped from the upper part of the bag, no boiloff was observed. Moreover, since it took out from the microwave oven the whole box after heating, it did not feel so hotly.

The entire disclosure of Japanese Patent Applications No. 2000-369403 filed on Dec. 5, 2000; No. 2000-384874 filed on Dec. 19, 2000; No. 2001-351225 filed on Nov. 16, 2001; No. 2001-385560 filed on Dec. 19, 2001, and No. 2001-385585 filed on Dec. 19, 2001 including their specifications, claims, drawings and summaries are incorporated herein by reference in its entirety.

What is claimed is:

1. Packaging bag for heating with en electromagnetic wave heating system, which comprises a lower member and an upper member, each of which is made of a composite film which has a sealant layer on at least one side, wherein said lower member uses the sealant side as the upper face, a portion of said upper member forms a wing part by doubling the portion while facing the sealant layer and sealing the open end edges of the doubled portion, the remaining portion of said upper member is superimposed on the lower member so that the sealant side of the remaining portion is used as the lower face to be opposite to the upper face of the lower member, and the edges of superimposed members are sealed, and wherein the wing part comprises a point-seal part formed therein, and a means for venting steam located within an area which is isolated from the first and second internal spaces by the point-seal part.

2. The packaging bag according to claim 1, wherein the point-seal part is located at a position between the point-seal parts and between the radius of a circle which touches the lowest end of the point-seal parts and the radius of the circle which touches the inner end of the side edge seal part of the bag, when circles are drawn by centering on the center of the bag.

3. The packaging bag according to claim 1, wherein a non-seal part is formed inside the point-seal part.

4. The packaging bag according to claim 1, wherein a pattern seal part is formed inside the point-seal part.

5. The packaging bag according to claim 1, wherein the means for venting steam is a cut or a hollow.

6. The packaging bag according to claim 5, wherein the distance between the lowest end of one or more cuts or hollows prepared in the point-seal part and the lowest end of point-seal part is 2–10 mm.

7. The packaging bag according to claim 1, wherein the ratio of the length between an end edge in the longitudinal direction of the packaging bag and the formation position of the wing part, to the length between the formation position of the wing part and the opposite end edge in the longitudinal direction of the packaging bag is in the range of 1/50 to 2/3.

8. The packaging bag according to claim 1, wherein said upper member consists of two pieces of film.

9. The packaging bag according to claim 1, wherein said upper member consists of one piece of film.

10. The packaging bag according to claim 1, wherein the upper member and the lower member are composed of a single piece of film.

11. Packaging container comprising the packaging bag according to claim 1 and a casing box for storing the bag, wherein the box has a prearranging portion capable of forming an opening, at the position that the wing part of the packaging bag installed therein is located, wherein the opening is that for pulling out the wing part to the outside of the box.

12. Packaging bag for heating with an electromagnetic wave heating system, which comprises a lower member and an upper member, each of which is made of a composite film which has a sealant layer on at least one side, wherein said lower member uses the sealant side as the upper face, a portion of said upper member forms a wing part by doubling the portion while facing the sealant layer and sealing the open end edges of the doubled portion, the remaining portion of said upper member is superimposed on the lower member so that the sealant side of the remaining portion is used as the lower face to be opposite to the upper face of lower member, and the edges of the superimposed members are sealed, wherein a fracturable portion is formed at a site of the sealed edge parts of the bag, and wherein the wing part comprises a point-seal part formed therein, and a means for venting steam located within an area which is isolated from the first and second internal spaces by the point-seal part.

13. The packaging bag according to claim 12, wherein the fracturable portion is a notch formed at a site of the tail end edge of the wing part.

14. The packaging bag according to claim 12, wherein the point-seal part is located at a position between the seal-point parts and between the radius of a circle which touches the lowest end of a point-seal parts and the radius of the circle which touches the inner end of the side edge seal part of the bag, when circles are drawn by centering on the center of the bag.

15. The packaging bag according to claim 12, wherein a non-seal part is formed inside the point-seal part.

16. The packaging bag according to claim 12, wherein a pattern seal part is formed inside the point-seal part.

17. The packaging bag according to claim 12, wherein the means for venting steam is a cut or a hollow.

18. The packaging bag according to claim 17, wherein the distance between the lowest end of one or more cuts or hollows prepared in the point-seal part and the lowest end of point-seal part is 2–10 mm.

19. The packaging bag according to claim 12, wherein the ratio of the length between an end edge in the longitudinal direction of the packaging bag and the formation position of the wing part, to the length between the formation position of the wing part and the opposite end edge in the longitudinal direction of the packaging bag is in the range of 1/50 to 2/3.

20. The packaging bag according to claim 12, wherein said upper member consists of two pieces of film.

21. The packaging bag according to claim 12, wherein said upper member consists of one piece of film.

22. The packaging bag according to claim 12, wherein the upper member and the lower member are composed of a single piece of film.

23. Packaging container comprising the packaging bag according to claim 12 and a casing box for storing the bag, wherein the box has a prearranging portion capable of forming an opening, at the position that the wing part of the packaging bag installed therein is located, wherein the opening is that for pulling out the wing part to the outside of the box.

24. Packaging bag for heating with an electromagnetic wave heating system, which comprises a lower member and an upper member, each of which is made of a composite film which has a sealant layer on at least one side, wherein said lower member uses the sealant side as the upper face, a portion of said upper member forms a wing part by doubling the portion while facing the sealant layer and sealing the open end edges of the doubled portion, the remaining portion of said upper member is superimposed on the lower member so that the sealant side of the remaining portion is used as the lower face to be opposite to the upper face of the lower member, and the edges of the superimposed members are sealed, and wherein the wing part comprises a point-seal part formed therein and which is continuously formed from the seal part or fold part at the tail end edge of a wing part, a means for venting steam located within an isolated area from the first and second internal spaces by the point-seal part.

25. The packaging bag according to claim 24, wherein the packaging bag further comprises control seal parts prepared within the wing part almost in parallel with the tail end edge of the wing part and toward the point-seal part from both side edge seal parts of the bag.

26. The packaging bag according to claim 24, wherein the point-seal part is located at a position between the point seal parts and between the radius of a circle which touches the lowest end of the point-seal parts and the radius of the circle which touches the inner end of the side edge seal part of the bag, when circles are drawn by centering on the center of the bag.

27. The packaging bag according to claim 24, wherein a non-seal part is formed inside the point-seal part.

28. The packaging bag according to claim 24, wherein a pattern seal part is formed inside the point-seal part.

29. The packaging bag according to claim 24, wherein the means for venting steam is a cut or a hollow.

30. The packaging bag according to claim 29, wherein the distance between the lowest end of one or more cuts or hollows prepared in the point-seal part and the lowest end of point-seal part is 2–10 mm.

31. The packaging bag according to claim 24, wherein the ratio of the length between an end edge in the longitudinal direction of the packaging bag and the formation position of the wing part, to the length between the formation position of the wing part and the opposite end edge in the longitudinal direction of the packaging bag is in the range of 1/50 to 2/3.

32. The packaging bag according to claim 24, wherein the end of the control seal part on the center side of the bag is located at a position between the circle which touches the lowest end of the means for venting steam and the circle which touches the uppermost end of the point-seal part, when coaxial circles are drawn by centering on the center of the bag, and the ratio of the length between the side edge of the packaging bag and the side edge of the point-seal part, to the length between the side edge of the packaging bag and the center side end of the control seal part is in the range of 8/7 to 8/3.

33. The packaging bag according to claim 24, wherein the control seal parts are formed in axial symmetry with respect to the axis in the longitudinal direction of the bag.

34. The packaging bag according to claim 24, wherein the bag further comprises a second area isolated from the first and second internal spaces which is formed by the control seal part, and an additional means for venting steam which is prepared in the second isolated area.

35. The packaging bag according to claim 24, wherein the seal part of the packaging bag has a seal strength provided in the wing part of not more than 25N/15 mm width at the temperature of not less than 90° C.

36. The packaging bag according to claim 24, wherein said upper member consists of two pieces of film.

37. The packaging bag according to claim 24, wherein said upper member consists of one piece of film.

38. The packaging bag according to claim 24, wherein the upper member and the lower member are composed of a single piece of film.

39. Packaging container comprising the packaging bag according to claim 24 and a casing box for storing the bag, wherein the box has a prearranging portion capable of forming an opening, at the position that the wing part of the packaging bag installed therein is located, wherein the opening is that for pulling out the wing part to the outside of the box.

40. Packaging bag which comprises a main body walls of which envelops a first internal space, a wing part which envelops a second internal space, a point-seal part formed within the wing part, and a means for venting steam located within an area which is isolated from the first and second inner spaces by the point-seal part;

wherein the first internal space is used for storing contents and is subjected to sealing to make a sealed space which consists of the first internal space and the second internal space being in communication after contents storing, wherein the wing part is formed of two walls mutually-faced and extended from the wall of the main body in the direction of intersecting to the face of main body, and wherein the second inner space is communicated with the first internal space at an end thereof and closed at other ends thereof.

41. The packaging bag according to claim 40, wherein the bag further comprises control seal parts which are formed within the wing part almost in parallel with the tail end edge of the wing part and toward the point seal part from both side seal parts of the bag.

42. The packaging bag according to claim 40, wherein the point seal part is continuously formed from the seal part or fold part at the tail end edge of a wing part.

43. The packaging bag according to claim 40, wherein the bag further comprises another area isolated from the first and second internal spaces which is formed by the control seal part formed in the wing part, and an additional means for venting steam which is prepared in this another area.

44. The packaging bag according to claim 40, wherein the bag further comprises a portion to be fractured being separately from the point-seal part and the means for venting steam.

45. The packaging bag according to claim 40, wherein the bag is installed in a casing box, which box has an prearranging portion capable of forming an opening, at the position that the wing part of the packaging bag installed therein is located, wherein the opening is that for pulling out the wing part to the outside of a box.

46. Packaging container comprising the packaging bag according to claim 40 and a casing box for storing the bag, wherein the box has a prearranging portion capable of forming an opening, at the position that the wing part of the packaging bag installed therein is located, wherein the opening is that for pulling out the wing part to the outside of the box.

47. Packaging bag for heating with an electromagnetic wave heating system, which comprises a lower member and an upper member, each of which is made of a composite film which has a sealant layer on at least one side, wherein said lower member uses the sealant side as the upper face, a portion of said upper member forms a wing part by doubling the portion while facing the sealant layer and sealing the open end edges of the doubled portion, the remaining portion of said upper member is superimposed on said lower member so that the sealant side of the remaining portion is used as the lower face to be opposite to the upper face of the lower member, and the edges of the superimposed members are sealed, and wherein the wing part comprises a point-seal pad formed therein, a means for venting steam located within an area which is isolated from the first and second internal spaces by the point-seal part, and control seal parts which are almost in parallel with the tail end edge of a wing part and toward the point-seal part from both side edge seal parts of the bag.

48. The packaging bag according to claim 47, wherein the point-seal part is located at a position between the point-seal parts and between the radius of a circle which touches the lowest end of the point-seal parts and the radius of a circle which touches the inner end of the side edge seal part of the bag, when circles are drawn by centering on the center of the bag.

49. The packaging bag according to claim 47, wherein the end of the control seal part on the center side of the bag is located at a position between the circle which touches the lowest end of the means for venting steam and the circle which touches the uppermost end of the point-seal part, when coaxial circles are drawn by centering on the center of the bag, and the ratio of the length between the side edge of the packaging bag and the side edge of the point-seal part, to the length between the side edge of the packaging bag and the center side end of the control seal part is in the range of 8/7 to 8/3.

50. The packaging bag according to claim 47, wherein a non-seal part is formed inside the point-seal part.

51. The packaging bag according to claim 47, wherein a pattern seal part is formed inside the point-seal part.

52. The packaging bag according to claim 47, wherein the means for venting steam is a cut or a hollow.

53. The packaging bag according to claim 52, wherein the distance between the lowest end of one or more cuts or hollows prepared in the point-seal part and the lowest end of point-seal part is 2–10 mm.

54. The packaging bag according to claim 47, wherein the ratio of the length between an end edge in the longitudinal direction of the packaging bag and the formation position of the wing part, to the length between the formation position of the wing part and the opposite end edge in the longitudinal direction of the packaging bag is in the range of 1/50 to 2/3.

55. The packaging bag according to claim 47, wherein the control seal parts are formed in axial symmetry with respect to the axis in the longitudinal direction of the bag.

56. The packaging bag according to claim 47, wherein the bag further comprises a second area isolated from the first and second internal spaces which is formed by the control seal part, and an additional means for venting steam which is prepared in the second isolated area.

57. The packaging bag according to claim 47, wherein the seal part of the packaging bag has a seal strength in the wing part of not more than 25N/15 mm width at the temperature of not less than 90° C.

58. The packaging bag according to claim 47, wherein said upper member consists of two pieces of film.

59. The packaging bag according to claim 47, wherein said upper member consists of a one piece of film.

60. The packaging bag according to claim 47, wherein the upper member and the lower member are composed of a single piece of film.

61. Packaging container comprising the packaging bag according to claim 47 and a casing box for storing the bag, wherein the box has a prearranging portion capable of forming an opening, at the position that the wing part of the packaging bag installed therein is located, wherein the opening is that for pulling out the wing part to the outside of the box.

* * * * *